US012060752B2

(12) United States Patent
McCorriston et al.

(10) Patent No.: US 12,060,752 B2
(45) Date of Patent: Aug. 13, 2024

(54) FLOOR WRENCH FOR A DRILLING RIG

(71) Applicant: DRILLFORM TECHNICAL SERVICES LTD, Calgary (CA)

(72) Inventors: Todd McCorriston, Calgary (CA); Vladimir Scekic, New Westminster (CA); Patrick McDougall, Calgary (CA); Mark Taggart, Calgary (CA)

(73) Assignee: DRILLFORM TECHNICAL SERVICES LTD., Calgary (CA)

( * ) Notice: Subject to any disclaimer, the term of this patent is extended or adjusted under 35 U.S.C. 154(b) by 0 days.

(21) Appl. No.: 18/172,280

(22) Filed: Feb. 21, 2023

(65) Prior Publication Data

US 2023/0203898 A1 Jun. 29, 2023

Related U.S. Application Data

(63) Continuation-in-part of application No. 16/760,585, filed as application No. PCT/CA2018/051379 on Oct. 30, 2018, now Pat. No. 11,608,694.

(60) Provisional application No. 62/578,676, filed on Oct. 30, 2017.

(51) Int. Cl.
*E21B 19/16* (2006.01)

(52) U.S. Cl.
CPC ..... *E21B 19/163* (2013.01); *E21B 19/166* (2013.01)

(58) Field of Classification Search
CPC .... E21B 19/163; E21B 19/161; E21B 19/164; E21B 19/165; E21B 19/16; E21B 19/166
See application file for complete search history.

(56) References Cited

U.S. PATENT DOCUMENTS

| | | | |
|---|---|---|---|
| 1,543,904 | A | 6/1925 | Carr |
| 1,656,864 | A | 1/1928 | Martin |
| 1,851,009 | A | 3/1932 | Hoffoss |

(Continued)

FOREIGN PATENT DOCUMENTS

| | | |
|---|---|---|
| CA | 2465530 | 3/2004 |
| CA | 2679698 | 9/2008 |

(Continued)

OTHER PUBLICATIONS

International Search Report and Written Opinion for International (PCT) Patent Application No. PCT/CA2014/000401, mailed Jul. 22, 2014, 8 pages.

(Continued)

*Primary Examiner* — Kipp C Wallace
(74) *Attorney, Agent, or Firm* — Sheridan Ross P.C.

(57) ABSTRACT

A wrench for making up or breaking up a pipe joint is provided. The wrench comprises a tong assembly having an upper tong and a lower tong. The upper tong has a first upper tong half pivotably connected to a second upper tong half at their first ends. The lower tong has a first lower tong half pivotably connected to a second lower tong half at their first ends. A central bearing operatively couples the upper tong and the lower tong to allow the upper tong to rotate relative to the lower tong or vice versa. The tong assembly has a ram assembly for pushing or pulling the upper tong at a tangential location thereof and the ram assembly is retracted or extended to move the tong assembly between an open position, a closed position, and a rotated closed position where the upper tong is rotated relative to the lower tong.

16 Claims, 16 Drawing Sheets

(56) References Cited

U.S. PATENT DOCUMENTS

| | | | | |
|---|---|---|---|---|
| 2,063,378 | A | 12/1936 | Hiniker | |
| 2,127,108 | A | 8/1938 | Driscoll | |
| 3,507,174 | A | 4/1970 | Dickmann | |
| 3,799,009 | A * | 3/1974 | Guier | E21B 19/164 81/57.2 |
| 3,919,902 | A | 11/1975 | Johnson | |
| 3,961,399 | A * | 6/1976 | Boyadjieff | E21B 19/168 188/67 |
| 4,295,527 | A | 10/1981 | Ruesse | |
| 4,372,026 | A | 2/1983 | Mosing | |
| 4,688,453 | A | 8/1987 | Schulze-Beckinghausen | |
| 4,765,401 | A | 8/1988 | Boyadjieff | |
| 5,060,542 | A | 10/1991 | Hauk | |
| 5,092,399 | A | 3/1992 | Lang | |
| 5,520,072 | A * | 5/1996 | Perry | E21B 19/163 81/57.16 |
| 6,142,041 | A | 11/2000 | Buck | |
| 6,318,214 | B1 | 11/2001 | Buck | |
| 7,191,686 | B1 * | 3/2007 | Angelle | E21B 19/168 81/57.16 |
| 7,204,173 | B2 | 4/2007 | Buck | |
| 7,707,914 | B2 | 5/2010 | Pietras et al. | |
| 7,861,618 | B2 | 1/2011 | Pietras et al. | |
| 7,926,557 | B2 | 4/2011 | Huebner et al. | |
| 8,020,626 | B2 | 9/2011 | Francis et al. | |
| 8,042,432 | B2 | 10/2011 | Hunter et al. | |
| 8,157,478 | B2 * | 4/2012 | Wentworth | F16L 55/1658 405/184 |
| 10,309,169 | B2 | 6/2019 | Scekic | |
| 10,538,976 | B2 | 1/2020 | Scekic et al. | |
| 11,608,694 | B2 | 3/2023 | McCorriston et al. | |
| 2004/0237726 | A1 | 12/2004 | Schulze-Beckinghausen | |
| 2009/0255662 | A1 | 10/2009 | Ge | |
| 2011/0030512 | A1 | 2/2011 | Begnaud, Jr. | |
| 2012/0323500 | A1 | 12/2012 | Prefontaine | |
| 2015/0082598 | A1 | 3/2015 | Lavalley et al. | |
| 2016/0102509 | A1 * | 4/2016 | Scekic | E21B 19/163 166/380 |
| 2019/0017336 | A1 * | 1/2019 | Saavedra | E21B 19/163 |
| 2022/0090454 | A1 | 3/2022 | Taggart et al. | |

FOREIGN PATENT DOCUMENTS

| | | |
|---|---|---|
| CA | 2773295 | 10/2013 |
| CN | 104895515 | 9/2015 |
| CN | 105134108 | 12/2015 |
| EP | 1517000 | 3/2005 |
| EP | 3097250 | 11/2016 |
| GB | 2400389 | 10/2004 |
| GB | 2433954 | 7/2007 |
| WO | WO 2004/025071 | 3/2004 |
| WO | WO 2011/060270 | 5/2011 |
| WO | WO 2014/179862 | 11/2014 |
| WO | WO 2016/183670 | 11/2016 |

OTHER PUBLICATIONS

European Search Report and Opinion for European Patent Application No. 14794384, mailed Dec. 15, 2016, 8 pages.
International Search Report and Written Opinion for International (PCT) Patent Application No. PCT/CA2015/000029, dated Apr. 29, 2015, 6 pages.
International Preliminary Patentability Report for International (PCT) Patent Application No. PCT/CA2015/000029, dated Jul. 28, 2016, 5 pages.
International Search Report and Written Opinion for International (PCT) Patent Application No. PCT/CA2018/051379, dated Jan. 28, 2019, 9 pages.
Extended European Search Report for Europe Patent Application No. 18873313.3, dated Jul. 12, 2021, 7 pages.
Official Action for U.S. Appl. No. 14/889,398, dated Nov. 2, 2017, 12 pages.
Official Action for U.S. Appl. No. 14/889,398, dated Jul. 10, 2018, 12 pages.
Official Action for U.S. Appl. No. 14/889,398, dated Jan. 11, 2019, 13 pages.
Notice of Allowance for U.S. Appl. No. 14/889,398, dated Sep. 10, 2019, 8 pages.
Official Action for U.S. Appl. No. 15/111,903, dated Sep. 19, 2018, 6 pages.
Notice of Allowance for U.S. Appl. No. 15/111,903, dated Jan. 23, 2019, 5 pages.
Official Action for U.S. Appl. No. 16/760,585, dated Oct. 14, 2021, 9 pages.
Notice of Alowance for U.S. Appl. No. 16/760,585, dated Oct. 21, 2022, 7 pages.
Official Action for U.S. Appl. No. 17/480,971, dated Feb. 2, 2023, 16 pages.
Official Action for U.S. Appl. No. 17/480,971, dated Jul. 27, 2023, 15 pages.
Official Action for U.S. Appl. No. 17/480,971, dated Dec. 13, 2023, 18 pages.

* cited by examiner

FLOOR WRENCH FOR A DRILLING RIG

CROSS REFERENCES

This application is a continuation-in-part of U.S. patent application Ser. No. 16/760,585 entitled "Floor Wrench For A Drilling Rig" filed Apr. 30, 2020, which is a national stage application under 35 U.S.C. § 371 and claims the benefit of PCT Application No. PCT/CA2018/051379 having an international filing date of Oct. 30, 2018, which designated the United States, which PCT application claimed the benefit of U.S. Provisional Patent Application No. 62/578,676, entitled "An Improved Automated Floor Wrench For A Drilling Rig", filed Oct. 30, 2017, the entirety of each of which are hereby incorporated by reference.

TECHNICAL FIELD

The present disclosure relates to improved automated floor wrenches for use on a drilling rig. More specifically, an improved automated floor wrench having power tong blocks for centering and gripping the drilling pipe around its circumference is provided.

BACKGROUND

Automated floor wrenches for drilling rigs are known. Conventionally, automated floor wrenches can comprise two rams opposed to one another, each ram having a pair of tong dies to contact and grip the drilling pipe, or three rams spaced 120 degrees apart around the circumference of the drilling pipe, each ram having a tong die to contact and grip the pipe.

To date, however, known wrenches have various deficiencies and shortcomings. For example, the force required for the dies to contact and grip the pipe can score or damage the pipe surface, resulting in premature pipe wear. The use of two or three rams also requires significant force placed on two, three or even four points on the drill pipe, which can cause the pipe to be squashed or deformed at those points, also resulting in premature wear and service life for the pipe.

Some drilling rig floor wrenches have been developed that can comprise an improved tong assembly having a plurality of articulated tong block, each tong block capable of being interlocked and interchangeable one with another, and each tong block having at least one die ram assembly, such as described in PCT/CA2014/000401.

SUMMARY

According to a broad embodiment of the present disclosure, there is provided a wrench comprising a tong assembly, the tong assembly comprising: an upper tong comprising a first upper tong half pivotably connected to a second upper tong half at their first ends, the first and second upper tong halves being releasably connectable at their second ends; a lower tong comprising a first lower tong half pivotably connected to a second lower tong half at their first ends, the first and second lower tong halves being releasably connectable at their second ends; a central bearing operatively coupling the upper tong and the lower tong to allow the upper tong to rotate relative to the lower tong; and a ram assembly for pushing or pulling the upper tong at a tangential location thereof; and wherein the ram assembly is configured to move the tong assembly between an open position where the second ends of the first and second upper tong halves and the second ends of the first and second lower tong halves are separated to define a mouth therebetween, and a closed position where the second ends of the first and second upper tong halves and the second ends of the first and second lower tong halves are engaged to defined an opening between the first upper and lower tong halves and the second upper and lower tong halves; wherein the ram assembly is fully retractable to place the tong assembly in the open position; and wherein the ram assembly is partially retractable to place the tong assembly in the closed position.

According to another broad embodiment of the present disclosure, there is provided a method of operating a tong assembly of a wrench, the method comprising: opening a tong assembly to provide access to a pipe opening defined therein by retracting a ram assembly coupled to the tong assembly, the tong assembly comprising an upper tong and a lower tong and a central bearing operatively coupling the upper and lower tongs to allow relative rotational movement therebetween, and the ram assembly being coupled to the upper tong and the lower tong; closing the tong assembly by extending the ram assembly, thereby pushing the upper tong at a tangential location thereof; and locking the upper and lower tongs.

According to another broad embodiment of the present disclosure there is provided a wrench for making up or breaking up a pipe joint. The wrench comprises: a tong assembly comprising: an upper tong comprising a first upper tong half pivotably connected to a second upper tong half at their first ends, the first and second upper tong halves being releasably connectable at their second ends; a lower tong comprising a first lower tong half pivotably connected to a second lower tong half at their first ends, the first and second lower tong halves being releasably connectable at their second ends; a coupling assembly for releasably and operatively coupling the upper tong and the lower tong; and a central bearing operatively coupling the upper tong and the lower tong to allow the upper tong to rotate relative to the lower tong; and a ram assembly for pushing or pulling the upper tong at a tangential location thereof; wherein the ram assembly is configured to move the tong assembly between an open position where the second ends of the first and second upper tong halves and the second ends of the first and second lower tong halves are separated to define a mouth therebetween, and a closed position where the second ends of the first and second upper tong halves and the second ends of the first and second lower tong halves are engaged to define an opening between the first upper and lower tong halves and the second upper and lower tong halves; wherein when the coupling assembly is coupled the ram assembly is moveable in a first direction to place the tong assembly in the open position; wherein when the coupling assembly is coupled the ram assembly is moveable in a second direction to place the tong assembly in the closed position; wherein when the tong assembly is placed in the closed position and the coupling assembly is uncoupled, the ram assembly is further moveable in the second direction to rotate the upper tong in a first rotational direction relative to the lower tong; and wherein the ram assembly is moveable in the first direction to rotate the upper tong in a second rotational direction relative to the lower tong, wherein the first rotational direction is opposite to the second rotational direction.

According to another broad embodiment of the present disclosure there is provided a method of operating a wrench, the method comprising the steps of: opening a tong assembly to provide access to a pipe opening defined therein by moving a ram assembly in a first direction, the tong assembly comprising an upper tong and a lower tong and a central bearing operatively coupling the upper and lower tongs and to allow relative rotational movement therebetween, and the ram assembly being coupled to the upper tong and the lower tong and a coupling assembly is coupled to releasably and operatively couple the upper tong and the lower tong; after opening the tong assembly, receiving a pipe joint in the pipe opening; after receiving the pip joint, closing the tong assembly by moving the ram assembly in a second direction, thereby pushing the upper tong and the coupled lower tong at a tangential location thereof; after closing the tong assembly, securely engaging the pipe joint by extending one or more dies in the lower tong radially inwardly within the pipe opening using one or more die rams in the lower tong; uncoupling the coupling assembly; further moving the ram assembly in the second direction to rotate the upper tong in a first rotational direction relative to the lower tong; and moving the ram assembly in the first direction to rotate the upper tong in a second rotational direction relative to the lower tong.

DESCRIPTION OF THE EMBODIMENTS

According to embodiments herein, an improved automated floor wrench used on a drilling rig floor is provided. The present wrench or improved apparatus 100 comprises a powerful, modular automated floor wrench operative to enhance accuracy and consistency of torque on the drill pipe, enabling easier and faster maintenance, and reducing downtime.

In some embodiments, the present apparatus 100 may provide 360 degrees of radial contact with the drill pipe, reducing slippage, tool joint wear and pipe distortion, and facilitating pipe alignment. Due to the large radial contact around the pipe circumference, the force required to be exerted by each die ram on the pipe during the operation of the wrench is reduced, thereby minimizing potential damage to both the pipe and the wrench itself. It is an advantage that the present apparatus 100 may accommodate varying pipe sizes and longer tool joints, while providing accurate torque on each section of drill pipe. It is a further advantage that the present apparatus 100 may be fully or partially automated, providing a wireless hands-free operating system, increasing overall safety, and allowing for remote measurement and monitoring of data at each pipe connection (thereby improving diagnostics and enabling preventative maintenance). The present apparatus will now be described having regard to FIGS. 1 to 23.

Figure 1:
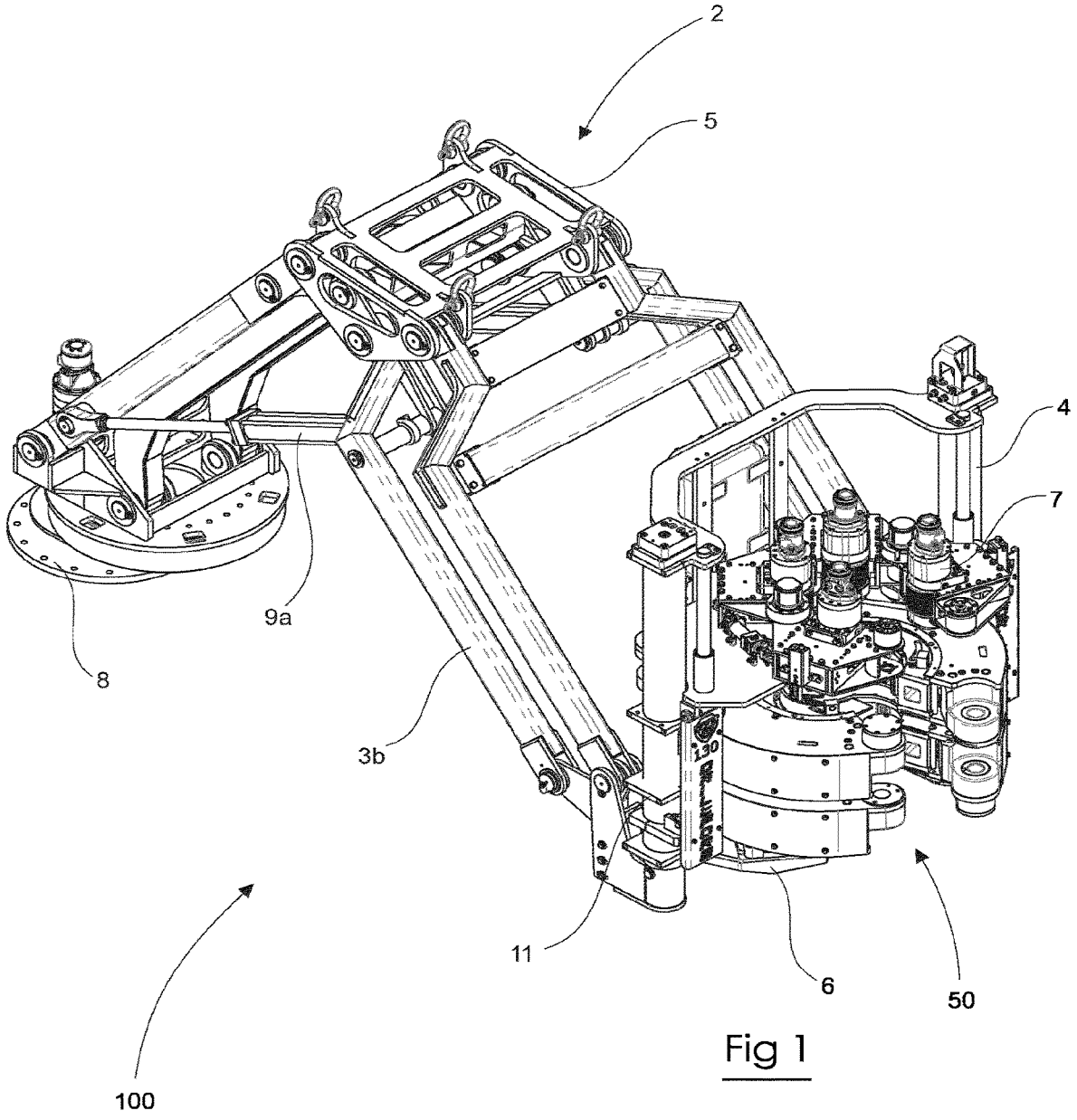
FIG. 1 is a side perspective view depicting a wrench according to one embodiment of the present disclosure.
Figure 2:
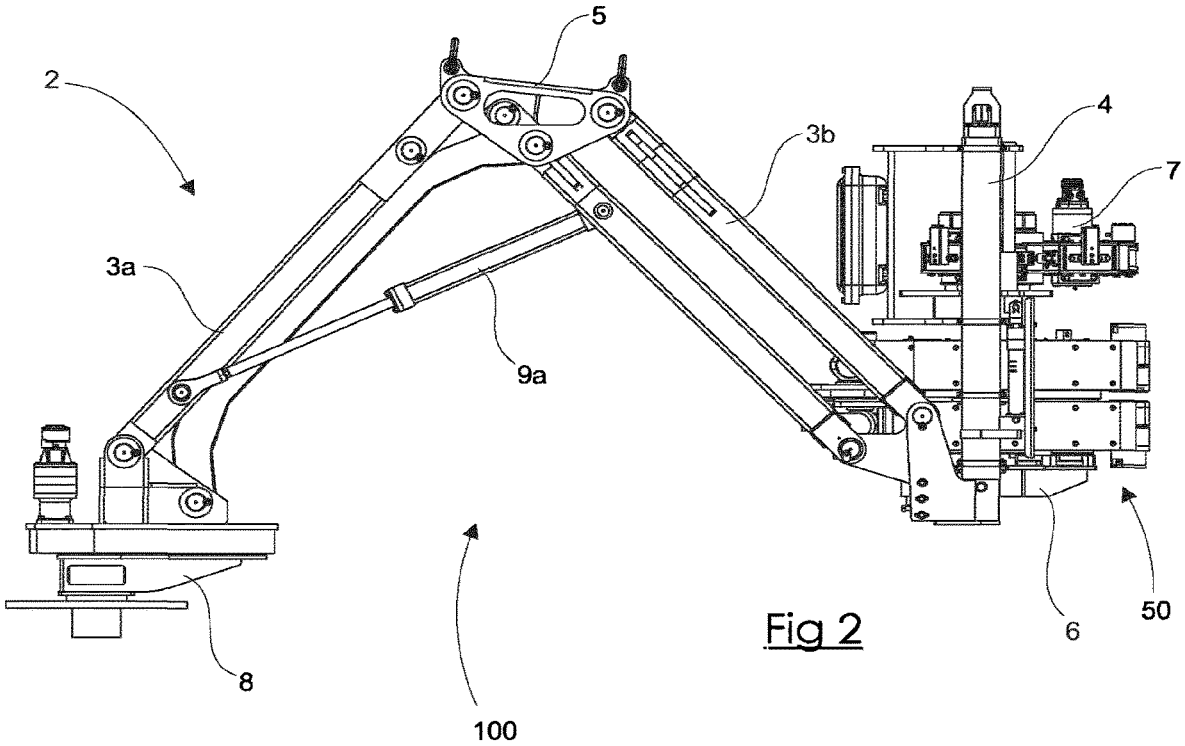
FIG. 2 is a side plan view of the wrench shown in FIG. 1.
Figure 3:
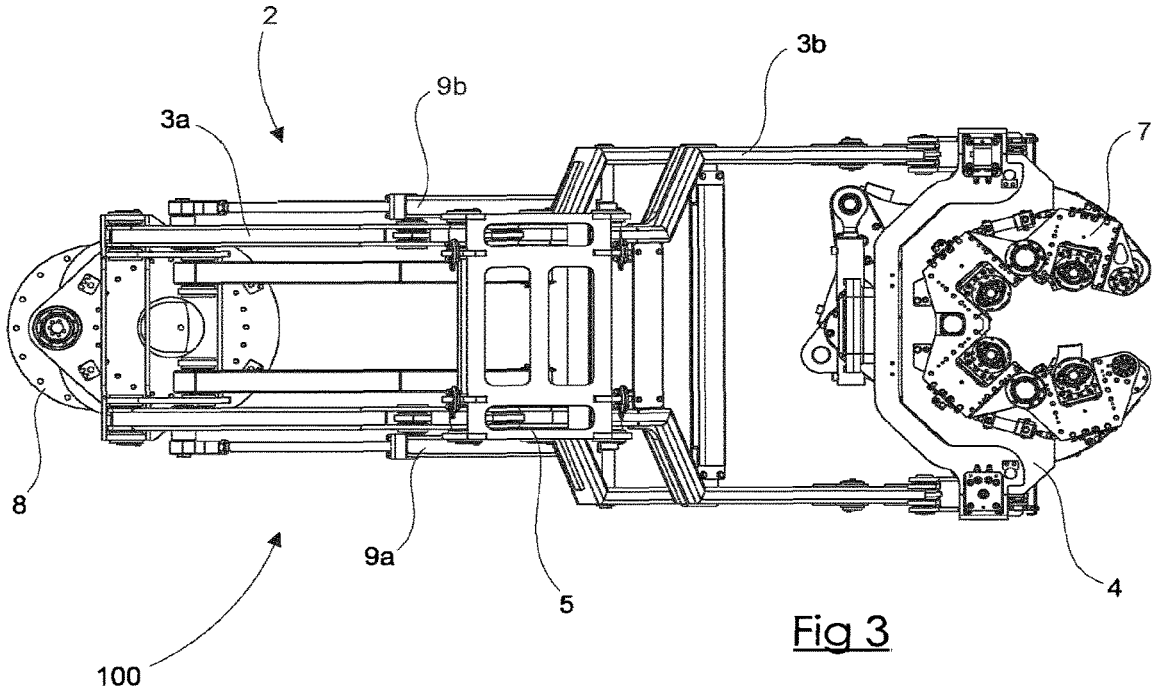
FIG. 3 is a top plan view of the wrench shown in FIG. 1.

Having regard to FIGS. 1 to 3, the present apparatus 100 can be mounted to a drilling rig floor. Broadly, in some embodiments, the present apparatus 100 may be mounted to the drilling rig floor by a rotatable positioning system 2, configured to receive and accommodate a tong assembly 50 of apparatus 100, such positioning system 2 comprising a rotatable base 8 and having a pivot arm configuration with at least two pivot arms 3*a*,3*b* pivotable about a first joint 5. Positioning system 2 further comprises a lift assembly 4 positioned at one end of the pivot arm 3*b* and the tong assembly 50 is supported and mounted on the lift assembly 4 via a carrier 6 and side mounts 11. The lift assembly 4 is configured to contain and control the movement of the tong assembly 50 disposed therein.

Having further regard to FIGS. 1 to 3, base 8 may include a downwardly protruding male shaft (not shown) that can be extended into a rig floor pocket and base 8 may further include a base plate that can be secured to a receiving plate mounted on the rig floor. Base 8 can thereby be rotatably positioned on the drilling rig floor, such that positioning system 2 is rotatable about a first axis (e.g. substantially perpendicular to the rig floor). Full rotation of the positioning system 2 about the first axis enables more precise and efficient alignment of the tong assembly 50 with a drill pipe (not shown), which may be located at the well center or at an additional mouse hole position on the rig floor. For example, where tong assembly 50 is misaligned with the drill pipe, positioning system 2 may be rotated (by any degree required) and carefully guided into alignment with the pipe.

Positioning system 2 may comprise at least two pivot arms 3*a*,3*b*; a first at least one pivot arm 3*a* operatively connected to and extending from base 8, while at least one second pivot arm 3*b* is configured to receive tong assembly 50 via lift assembly 4. In this regard, as the base 8 of the positioning system rotates about the first axis, at least two pivot arms 3*a*,3*b* and correspondingly the tong assembly 50, also rotates. The at least two pivot arms 3*a*,3*b* may be pivotable about pivot joint 5, such pivoting (i.e. extending and retracting) operably powered by at least one hydraulic cylinder, and preferably by at least two hydraulic cylinders 9*a*,9*b*.

In this regard, positioning system 2 may be operative to open or close (i.e. between extended or retracted positions) about joint 5; rotate about base 8; and move the lift assembly 4 up or down, so as to maneuver the tong assembly 50 about the drilling rig floor (i.e. to and away from the wellbore) with six degrees of freedom. As would be appreciated, the present positioning system 2 significantly reduces the overall footprint of the apparatus 100, and provides that when not in use, the apparatus 100 may be retracted into a closed position and rotated away from the wellbore, for example by about 90 degrees to about 180 degrees from the apparatus' operating position. In FIGS. 1 to 3, wrench 100 is shown with the positioning system 2 in the extended position.

Still with reference to FIGS. 1 to 3, the present apparatus 100 may be used in combination with a spinner assembly 7. It should be appreciated that the spinner may be a conventional spinner known in the art, and having up to 12" of independent vertical travel, and the ability to accommodate varying pipe sizes and longer tool joints.

With reference to FIGS. 4 to 11, wrench 100 comprises a tong assembly 50, which may comprise an upper tong 52, a lower tong 54, and carrier 6. Upper tong 52 is rotatably disposed on lower tong 54, with a central bearing 64 (shown in FIG. 21) operatively coupling the two tongs together, thereby enabling upper tong 52 to rotate relative to lower tong 54 about a common central axis, while lower tong 54 is held stationary by carrier 6. In some embodiments, tong assembly 50 can comprise one or more pins extending downwardly from lower tong 54 that can be inserted into corresponding apertures through carrier 6. Carrier 6 may further comprise a mounting pivot 22.

To enable rotational movement between the tongs, tong assembly can comprise a hydraulic ram assembly 58 for pushing one tong at a tangential location relative to the other, and for pulling one tong at a tangential location relative to the other. In one embodiment, to rotate upper tong 52 counter-clockwise relative to lower tong 54 (when viewed from above) to break a pipe joint, the ram assembly 58 pushes the upper tong 52 tangentially. To rotate upper tong 52 clockwise relative to lower tong 54 to make a pipe joint, the ram assembly 58 pulls the upper tong 52 tangentially. It would be understood that the reverse motions could also be used in certain embodiments. The ram assembly 58 and the rotation of the tongs 52,54 relative to one another will be described in more detail below.

Referring to FIGS. 4 to 11, in some embodiments, the ram assembly comprises an upper ram 58*a* and a lower ram 58*b*. Upper ram 58*a* is pivotably coupled at one end to upper tong 52 via an upper ram mount 57*a*, which extends outwardly from a main body of the upper tong 52. The other end of the upper ram 58*a* is pivotably coupled to a rod pin 61*b* disposed on a lower ram mount 57*b*, which extends outwardly from a main body of the lower tong 54. Rod pin 61*b* extends from an upper surface of the lower ram mount 57*b*. Similarly, lower ram 58*b* is pivotably coupled at one end to lower tong 54 via ram mount 57*b*. The other end of lower ram 58*b* is pivotably coupled to a rod pin 61*a* disposed on the upper ram mount 57*a*. Rod pin 61*a* extends from a lower surface of the upper ram mount 57*a*. In some embodiments, rams 58*a*,58*b* are substantially parallel to one another on one plane and an acute angle may be defined therebetween on another plane. Each of the upper and lower rams 58*a*,58*b* has an extended position (shown in FIGS. 10 and 11), a partially-retracted position (shown in FIGS. 6 and 7), and a fully retracted position (shown in FIGS. 4, 5, 8, and 9). In operation, both the upper and lower rams 58*a*, 58*b* extend and retract synchronously such that the rams are always in the same position relatively to one another.

In some embodiments, wrench 100 may comprise at least one tong torque sensor (not shown) mounted thereon for measuring axial stresses. The tong torque sensor can be mounted between rod pins 61*a*, 61*b* and upper and lower ram mounts 57*a*,57*b*. In some embodiments, a load cell is provided at each of the rod pins 61*a*, 61*b* to measure true torque between the upper and lower tongs 52,54.

Referring to FIGS. 4 to 23, an embodiment of tong assembly 50 is shown. In some embodiments, as best shown in FIGS. 4, 12, 13, 18 and 19, upper tong 52 comprises a first upper tong half 56*a* and a second upper tong half 56*b*. The first tong half 56*a* has a body portion having defined therein a substantially semi-circular arc. In some embodiments, the upper ram mount 57*a* extends outwardly from the first upper tong half 56*a* near a first end of the arc. The second tong half 56*b* also has a body portion having defined therein a substantially semi-circular arc, which is substantially a mirror image of the arc in the first tong half 56*a*. The first and second upper tong halves 56*a*,56*b* are hinged together and pivotably connected at their respective first ends via pin 59. In some embodiments, the second end of the arc of the first upper tong half 56*a* comprises a locking pin assembly 68*a* and the second end of the arch of the second upper tong half 56*b* comprises a pin pocket 70*a* having a bore for receiving a pin of the locking pin assembly 68*a* therethrough.

Similarly, lower tong 54 comprises a first lower tong half 66*a* and a second lower tong half 66*b*. The first tong half 66*a* has a body portion having defined therein a substantially semi-circular arc. The second tong half 66*b* also has a body portion having defined therein a substantially semi-circular arc, which is substantially a mirror image of the arc in the first lower tong half 66*a*. In some embodiments, the lower ram mount 57*b* extends outwardly from the second lower tong half 66*b* near a first end of the arc. The first and second lower tong halves 66*a*,66*b* are hinged together and pivotably connected at their respective first ends via pin 69. In some embodiments, the second end of the arc of the second lower tong half 66*b* comprises a locking pin assembly 68*b* and the second end of the arch of the first lower tong half 66*a* comprises a pin pocket 70*b* having a bore for receiving a pin of the locking pin assembly 68*b* therethrough. In some embodiments, pin 69 may extend into the mounting pivot 22 of carrier 6 (shown in FIG. 23).

Of course, the configuration of the second ends of each of the first and second upper and lower tong halves 56*a*, 56*b*, 66*a*, 66*b* described above is only one possible configuration. In other embodiments, the placement of the locking pin assemblies and pin pockets may be reversed. In alternative embodiments, the ends of the upper and lower tong halves may comprise connectable male and/or females ends. As one skilled in the art can appreciate, a number of different configurations is possible as long as the second ends of the first and second upper tong halves 56*a*,56*b* are connectable and the second ends of the first and second lower tong halves 66*a*,66*b* are connectable.

Figure 4:
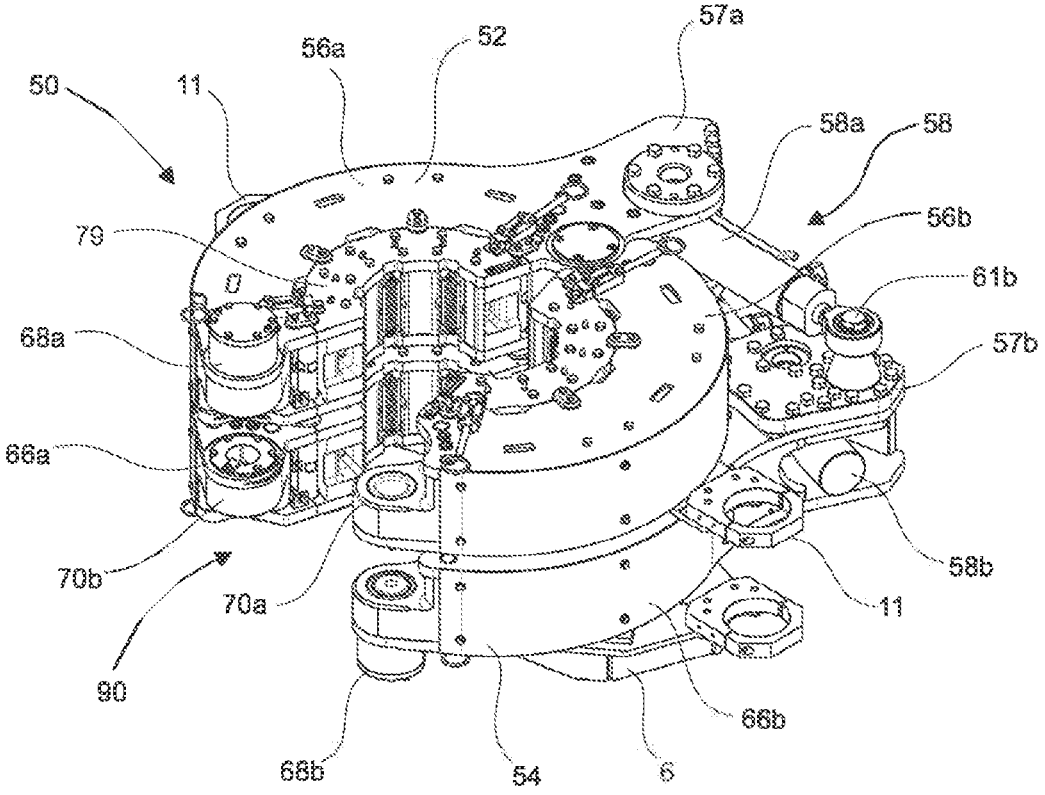
FIG. 4 is a front perspective view of a tong assembly of the wrench shown in FIG. 1 according to one embodiment, the tong assembly being shown in an open position.
Figure 5:
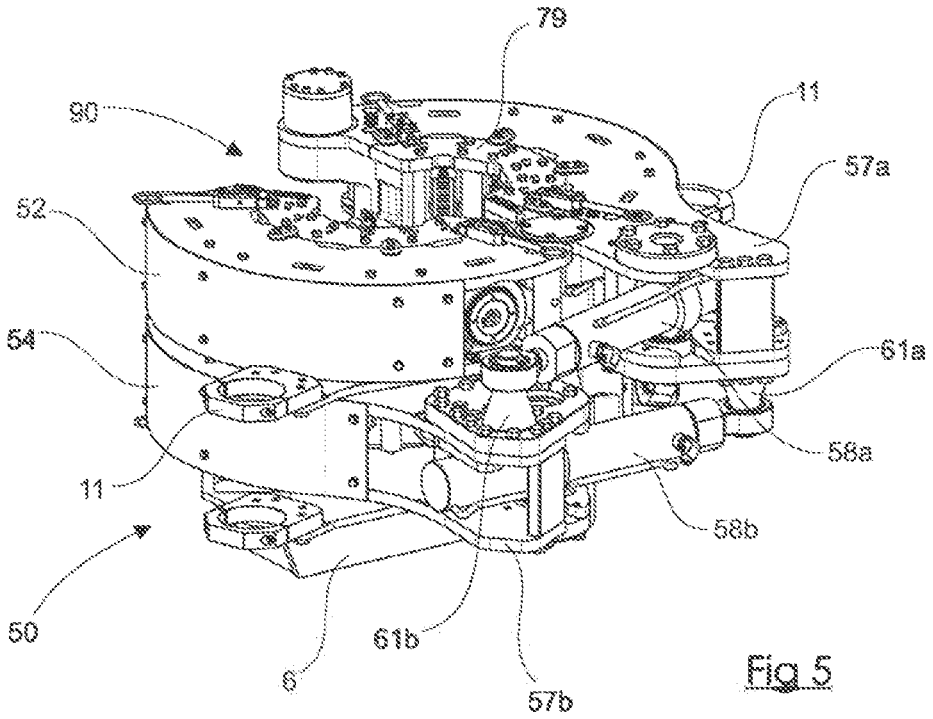
FIG. 5 is a rear perspective view of the tong assembly of FIG. 4.
Figure 6:
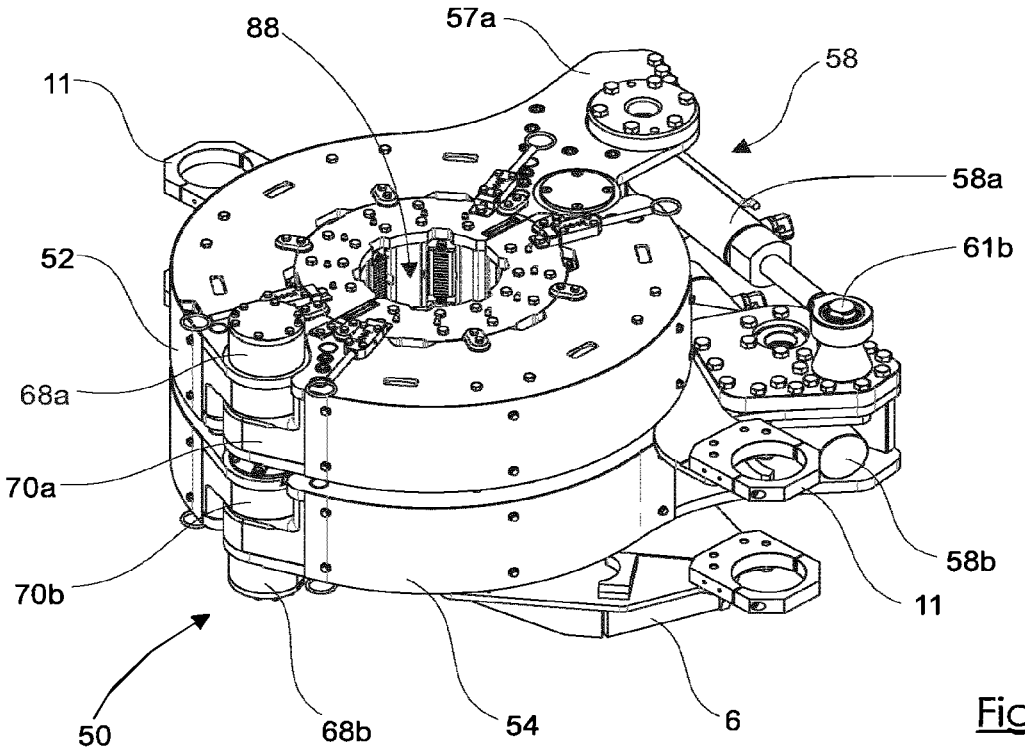
FIG. 6 is a front perspective view of the tong assembly of FIG. 4, shown in a closed position.
Figure 7:
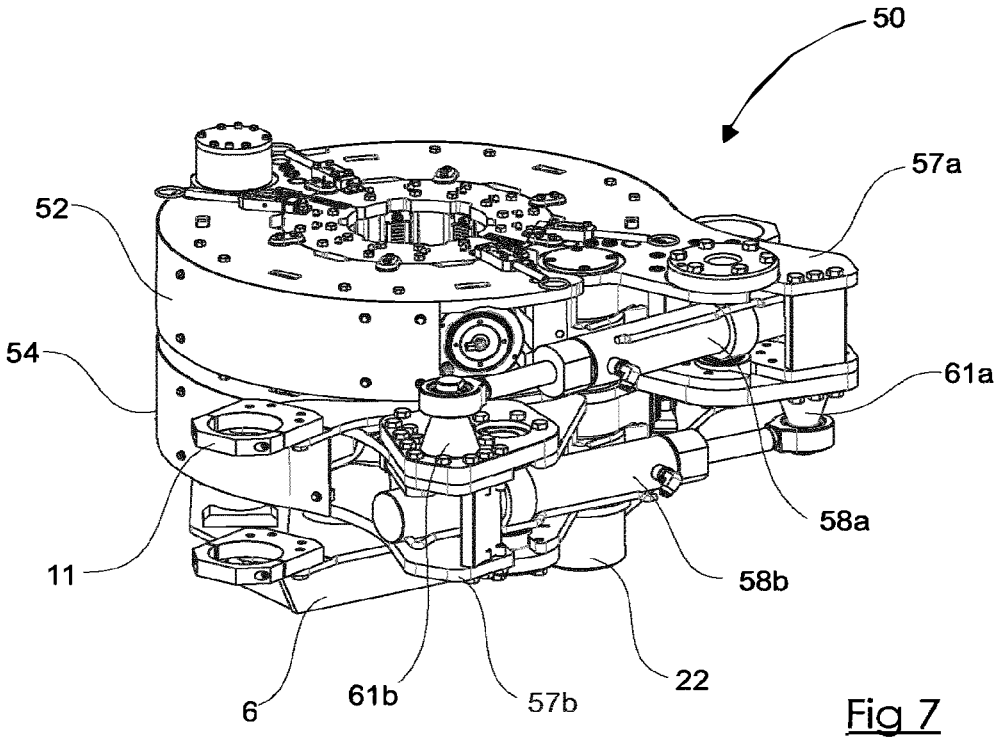
FIG. 7 is a rear perspective view of the tong assembly shown in FIG. 6.
Figure 8:
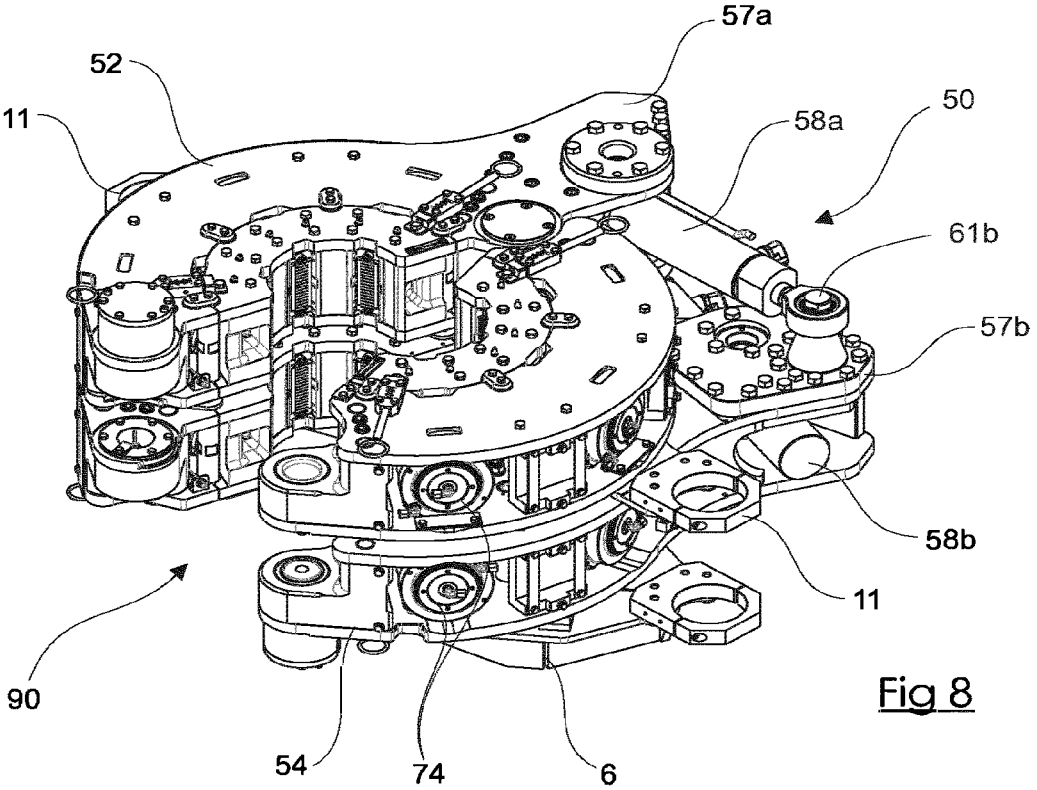
FIG. 8 is a front perspective view of the tong assembly of FIG. 4, shown without its side covers.
Figure 9:
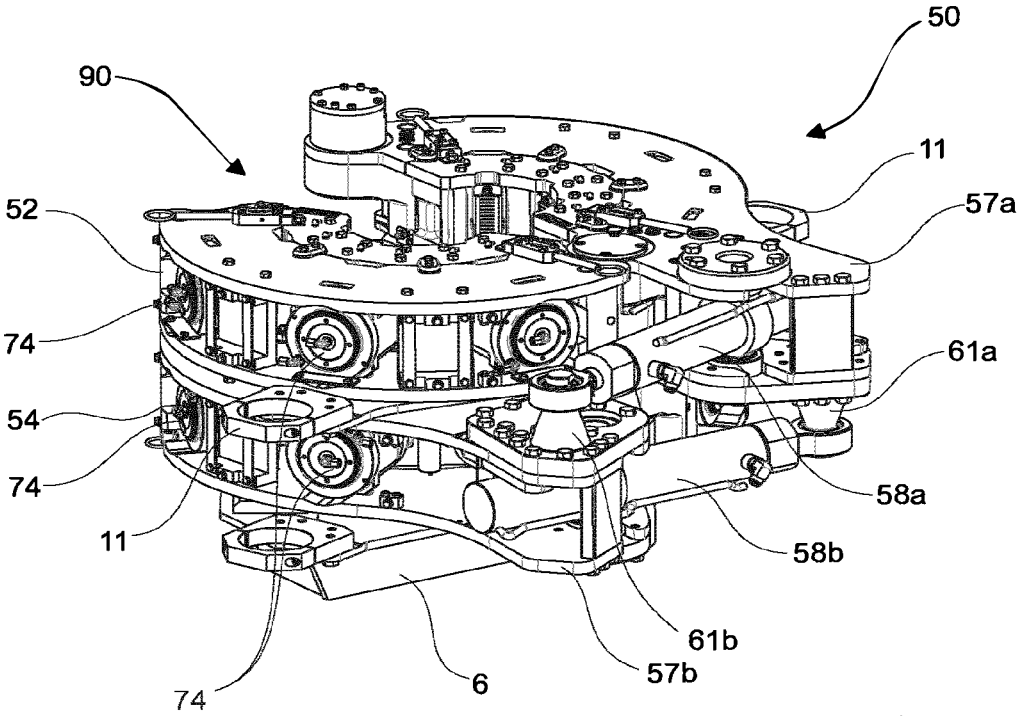
FIG. 9 is a rear perspective view of the tong assembly shown in FIG. 8.
Figure 10:
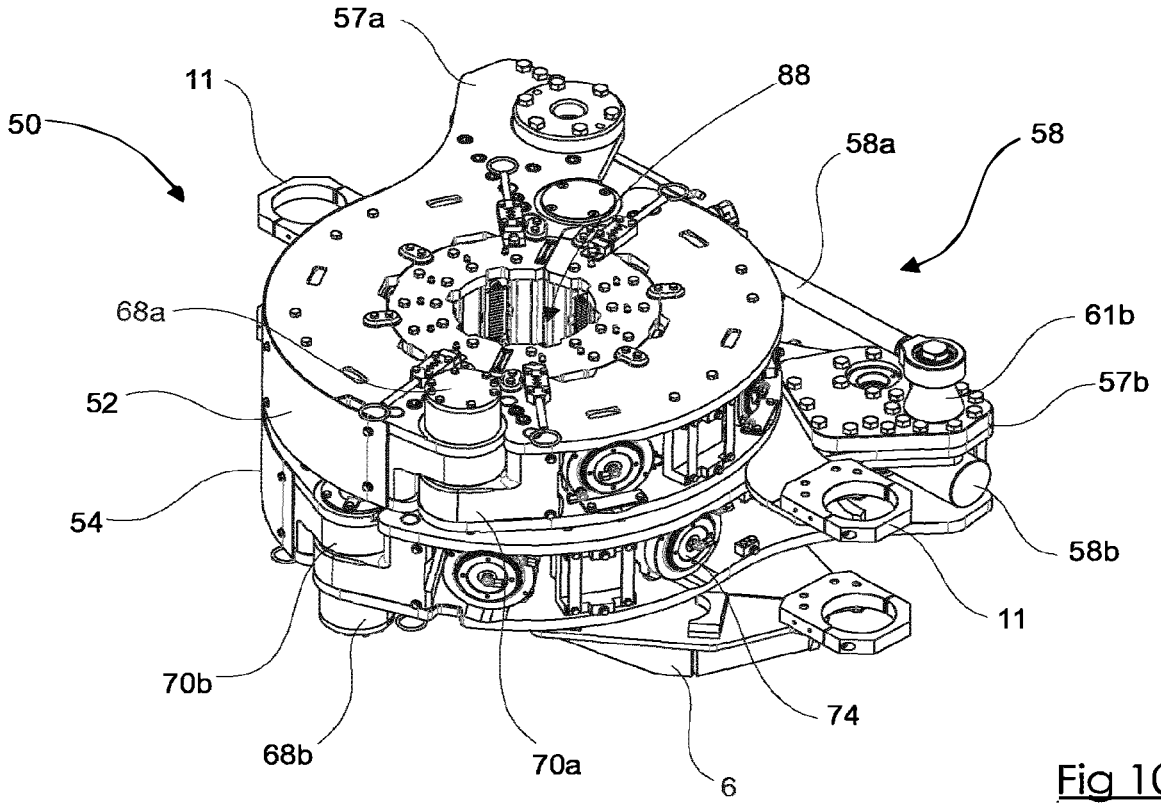
FIG. 10 is a front perspective view of the tong assembly of FIG. 8, shown in a rotated closed position, without some of its side covers.
Figure 11:
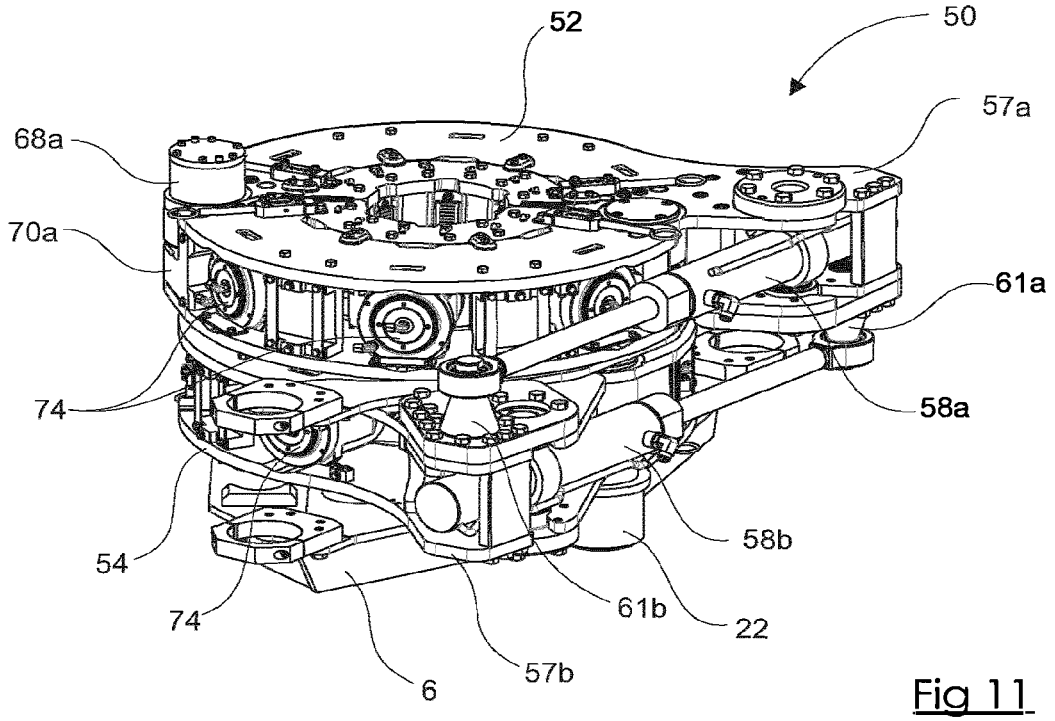
FIG. 11 is a rear perspective view of the tong assembly shown in FIG. 10.
Figure 13:
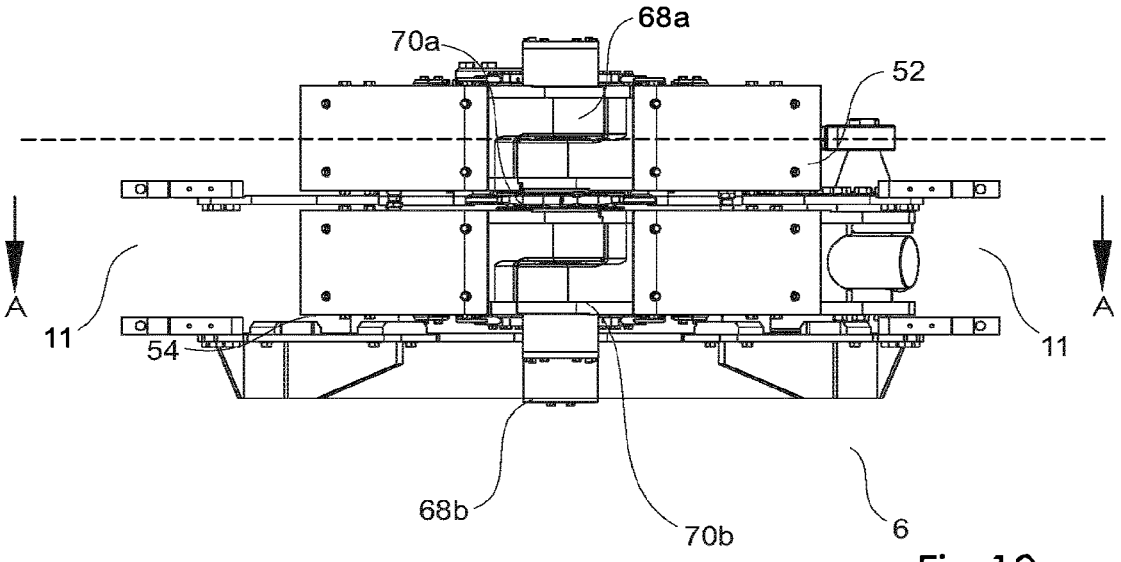
FIG. 13 is a front plan view of the tong assembly shown in FIG. 4.

The tong assembly 50 has an open position, shown in at least FIGS. 4, 5, 8, and 9, a closed position, shown in at least FIGS. 6 and 7, and a rotated closed position, shown in at least FIGS. 10, 11, and 13. In both the open and closed positions, the second ends of the first upper tong half 56*a* is aligned with that of the first lower tong half 66*a* and the second end of the second upper tong half 56*b* is aligned with that of the second lower tong half 66*b*. In an illustrative embodiment, in both the open and closed positions, the pin pocket 70*a* of the second upper tong half 56*b* is aligned with the locking pin assembly 68*a* of the first upper tong half 56*a*; the locking pin assembly 68*b* of the second lower tong half 66*b* is aligned with the pin pocket 60*b* of the first lower tong half 66*a*; and the upper and lower locking pin assemblies 68*a*,68*b* and the upper and lower pin pockets 70*a*,70*b* are substantially aligned with one another. In the rotated closed position, the pin pocket 70*a* of the second upper tong half 56*b* is aligned with the locking pin assembly 68*a* of the first upper tong half 56*a*; the locking pin assembly 68*b* of the second lower tong half 66*b* is aligned with the pin pocket 60*b* of the first lower tong half 66*a*; and the upper and lower locking pin assemblies 68*a*,68*b* and the upper and lower pin pockets 70*a*,70*b* are not aligned with one another.

Figure 15:
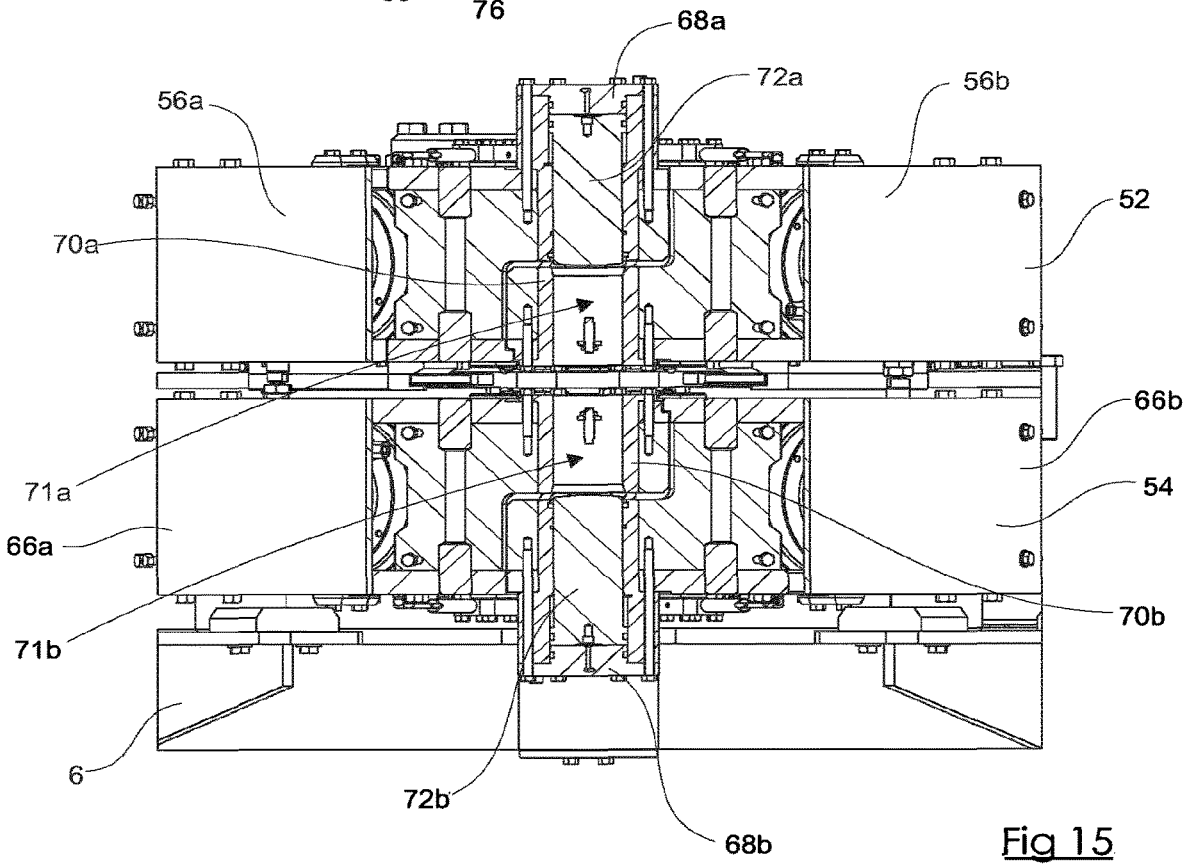
FIG. 15 is a cross-section view of the tong assembly, taken along line B-B of FIG. 12.

In the open position, the second ends of the first upper and lower tong halves 56*a*,66*a* are separated from the second ends of the second upper and lower tong halves 56*b*,66*b* to define a mouth 90 therebetween. In the open position, the upper and lower rams 58*a*,58*b* are in the fully retracted position. In other words, the upper and lower rams 58*a*,58*b* are fully retracted to place the tong assembly 50 in the open position. In the closed position and the rotated closed position, the second ends of the first upper and lower tong halves 56*a*,66*a* can be releasably coupled to the second ends of the second upper and lower tong halves 56*b*,66*b*, respectively. In the illustrated embodiment, as best shown in FIG. 15, when the tong assembly 50 is in the closed position, a pin of the locking pin assembly 68*a* of the first upper tong half 56*a* can be received in the pin pocket 70*a* of the second upper tong half 56*b*, and a pin of the locking pin assembly 68*b* of the second lower tong half 66*b* can be received in the pin pocket 70*b* of the first lower tong half 66*a*, to thereby lock the upper and lower tongs 52,54, respectively.

In the closed position and the rotated closed position, the arcs of the first and second upper tong halves 56*a*,56*b* form a substantially circular opening 89*a*. Similarly, the arcs of the first and second lower tong halves 66*a*,66*b* form a substantially circular opening 89*b*.

In the closed position, as shown for example in FIGS. 6 and 7, the upper and lower rams 58*a*,58*b* are in the partially-retracted position. In the illustrated embodiment, when the second ends of the upper tong halves 56*a*,56*b* and the second ends of the lower tong halves 66*a*,66*b* are aligned, the upper and lower rams 58*a*,58*b* are in the partially-retracted position. In the rotated closed position, as shown for example in FIGS. 10 and 11, the upper and lower rams 58*a*,58*b* are in the extended position. In the illustrated embodiment, when the second ends of the upper tong halves 56*a*,56*b* and the second ends of the lower tong halves 66*a*,66*b* are not aligned (i.e. when the upper tong 52 is rotated relative to the lower tong 54), the upper and lower rams 58*a*,58*b* are in the extended position.

Figure 14:
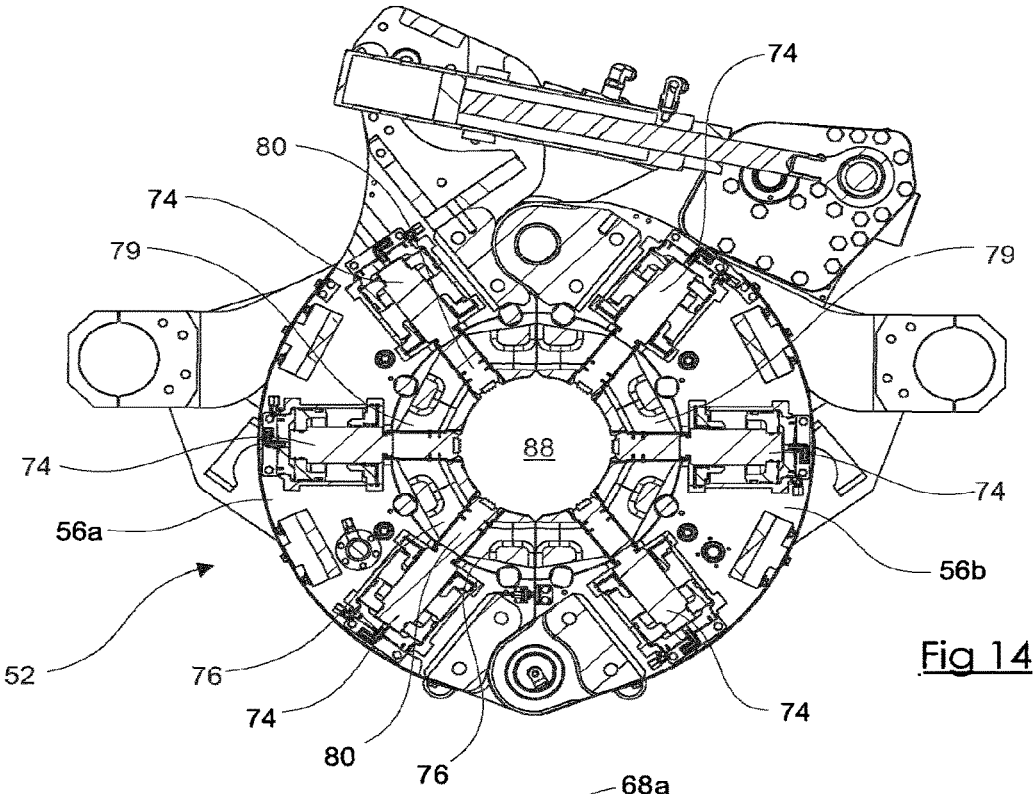
FIG. 14 is a cross-sectional view of the tong assembly, taken along line A-A of FIG. 13.

In some embodiments, with reference to FIGS. 14, 18, 19, and 22 each of the first and second upper tong halves 56*a*,56*b* and the first and second lower tong halves 66*a*,66*b* comprises one or more die rams. The die rams in the upper and lower tongs 52, 54 are substantially identical so only the die rams in the upper tong 52 will be described in detail. Referring to FIG. 14, a cross-sectional view of the upper tong 52 is shown. In the illustrated embodiment, the first upper tong half 56*a* comprises three die rams 74 and the second upper tong half 56*a* also comprises three die rams 74. However, as one skilled in the art can appreciate each tong half may comprise fewer or more die rams. The die ram 74 operates to extend or retract a die in a die cartridge, which will be described in detail below.

Figure 22:
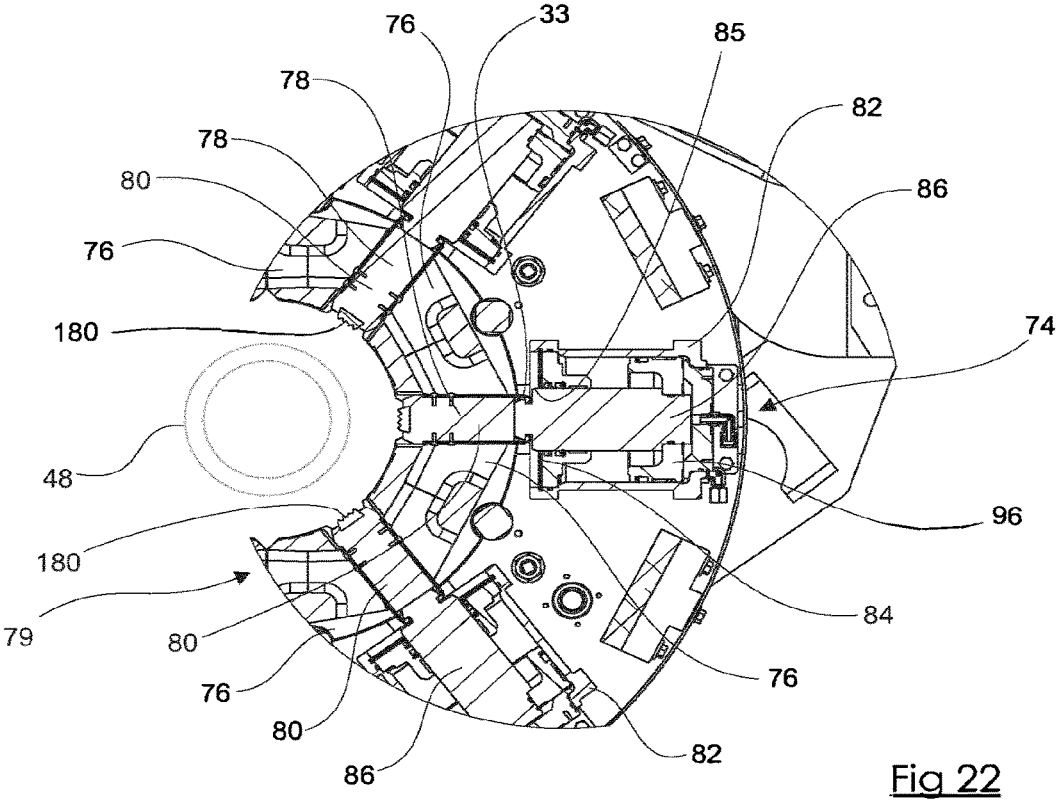
FIG. 22 is a detailed view of area "F" of the tong assembly shown in FIG. 14.

In some embodiments, with reference to FIG. 22, each die ram 74 comprises a die ram housing 82, a ram piston 96, a ram rod 86, and a cover 84 having defined therein an aperture 85. The cover 84 is mounted on an open end of the die ram housing 82 and the ram piston 96 and the ram rod 86 are disposed inside die ram housing 82, with one end of the ram rod 86 extending through aperture 85. The piston 96 operates to extend or retract the ram rod 86 axially through the aperture 85.

Figure 18:
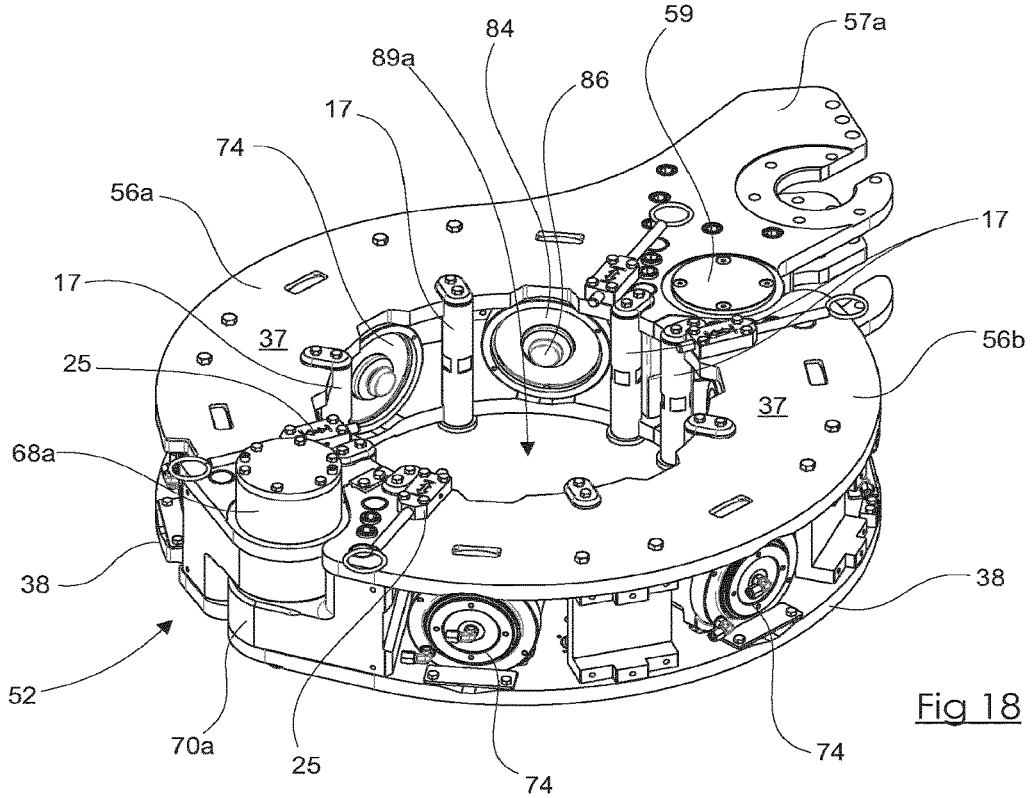
FIG. 18 is a front perspective view of the upper tong of the tong assembly of FIG. 4, shown without the die cartridges.

Each die ram 74 is disposed in the body portion of each of the tong halves 56*a*, 56*b*, 66*a*, 66*b* between the first and second ends thereof. The die rams 74 may be evenly spaced throughout the tong halves such that the space between adjacent die rams is substantially the same in each of the upper and lower tongs 52, 54. In the illustrated embodiment, as shown in FIG. 18, the body portion of each of the first and second upper tong halves 56*a*,56*b* comprises an upper tong plate 37 and a lower tong plate 38, each plate having at least one recess defined therein. The housing 82 is received in the respective recesses in the upper and lower plates and is secured between the upper and lower plates 37,38, with cover 84 facing inwardly towards the center of circular opening 89*a* such that the ram rod 86 is extendable radially inwardly in circular opening 89*a*. In some embodiments, the upper and lower plates 37,38 may be bolted or otherwise secured together using spacer assemblies throughout the upper and lower tongs 52,54. This allows the die rams 74 therebetween to be removed and/or replaced, as desired or as necessary, from the outer circumference of the tong assembly 50. Further, the upper and lower plates 37,38 are configured to accommodate a die cartridge, as described in more detail below.

Figure 19:
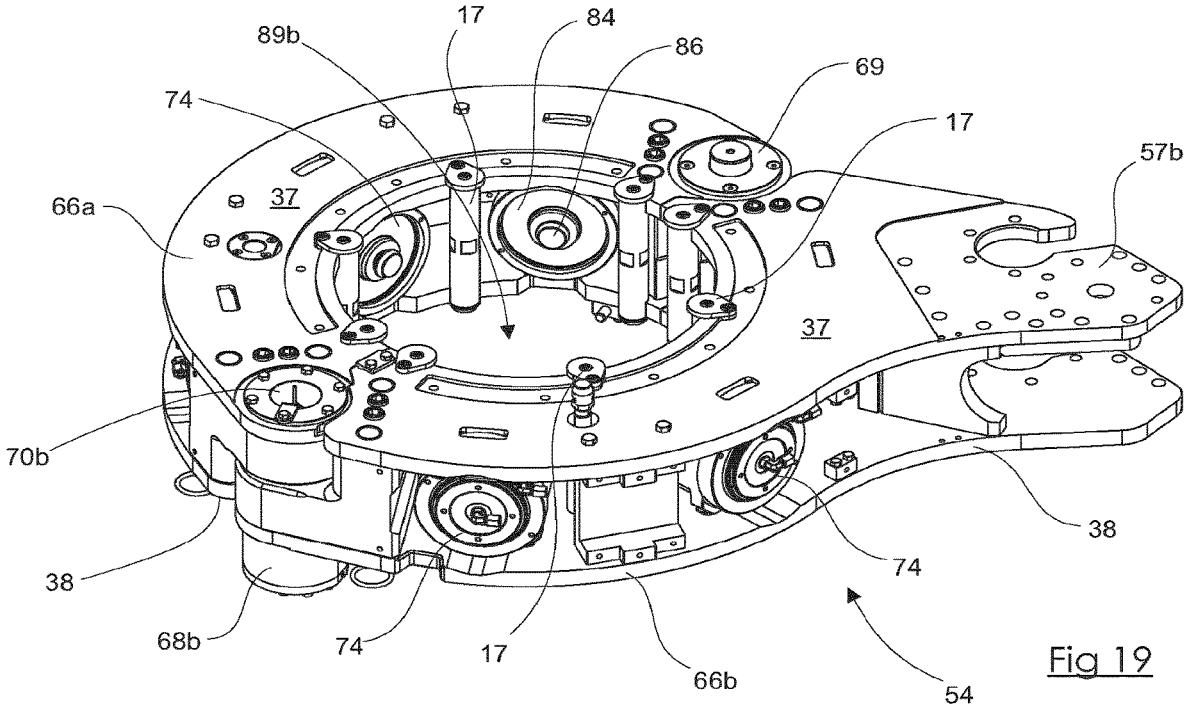
FIG. 19 is a front perspective view of the lower tong of the tong assembly of FIG. 4, shown without the die cartridges.
Figure 20:
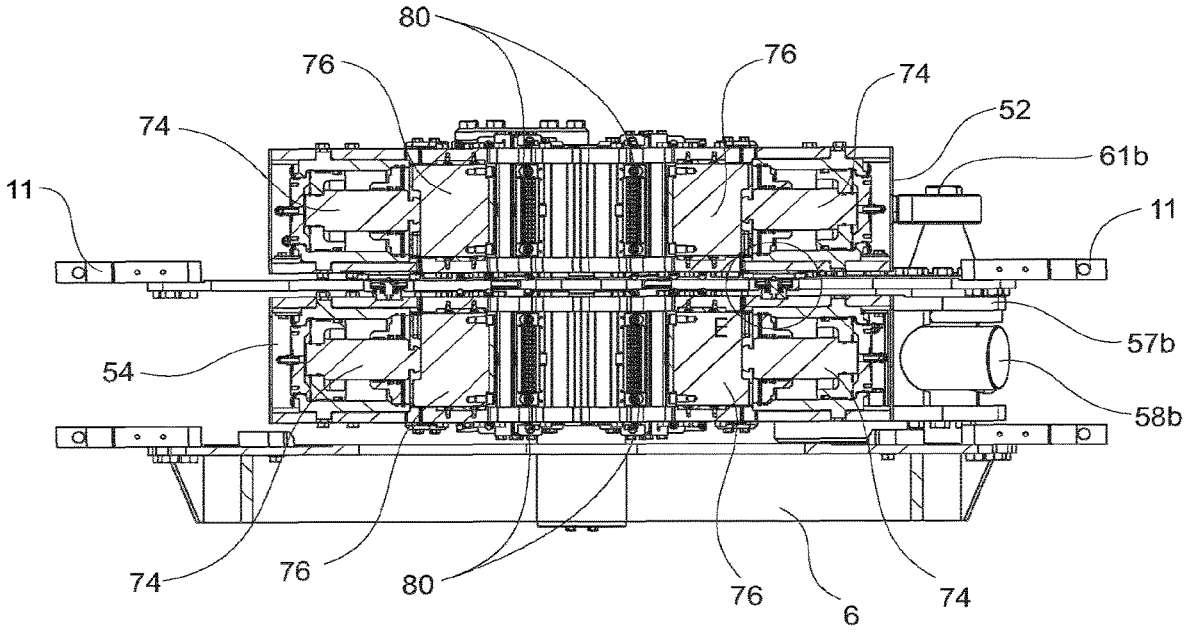
FIG. 20 is a cross-sectional view of the tong assembly, taken along line D-D of FIG. 12.

In some embodiments, as best shown in FIGS. 18 and 19, the upper and lower tongs 52,54 comprise one or more torque reaction bars 17, each extending between the upper and lower plates 37,38.

With reference to FIGS. 12, 14, 16, 17, 22, and 23, each tong half 56*a*, 56*b*, 66*a*, 66*b* is configured to removably receive a die cartridge 79. As best shown in FIGS. 14, 16, 17, and 22, each die cartridge 79 comprises one or more dies 80 and two or more die guides 76. Each die 80 comprises a die pad 180 removably mounted on a die holder 78 in a slot disposed on a front face thereof. Each die 80 is disposed between two die guides 76. In the illustrated embodiment, the die cartridge 79 has three dies 80 and four die guides 76, in an alternating arrangement and secured between two arc-shaped cartridge plates 34. The die cartridge 79 may further comprise locking clips 33 for engaging ram rod 86 to allow die 80 to move together with ram rod 86. The die cartridge 79 is configured to allow dies 80 to move radially inwardly towards the center of the semicircular space defined by the inner arcs of the cartridge plates 34.

In some embodiments, the upper and lower cartridge plates 34 have one or more aligning pairs of torque reaction pockets 28, each pair for matingly receiving a corresponding torque reaction bar 17 of the upper or lower tong 52,54. The torque reaction pockets 28 and torque reaction bars 17 are for facilitating the transfer of torque from the cartridge 79 to the upper and lower tongs 52,54 when the wrench 100 is in operation, as will be explained in more detail below. More specifically, in operation, torque is transferred from the dies 80 through the die guides 76 into cartridge plates 34 and then into the upper and lower tongs 52, 54.

Figure 12:
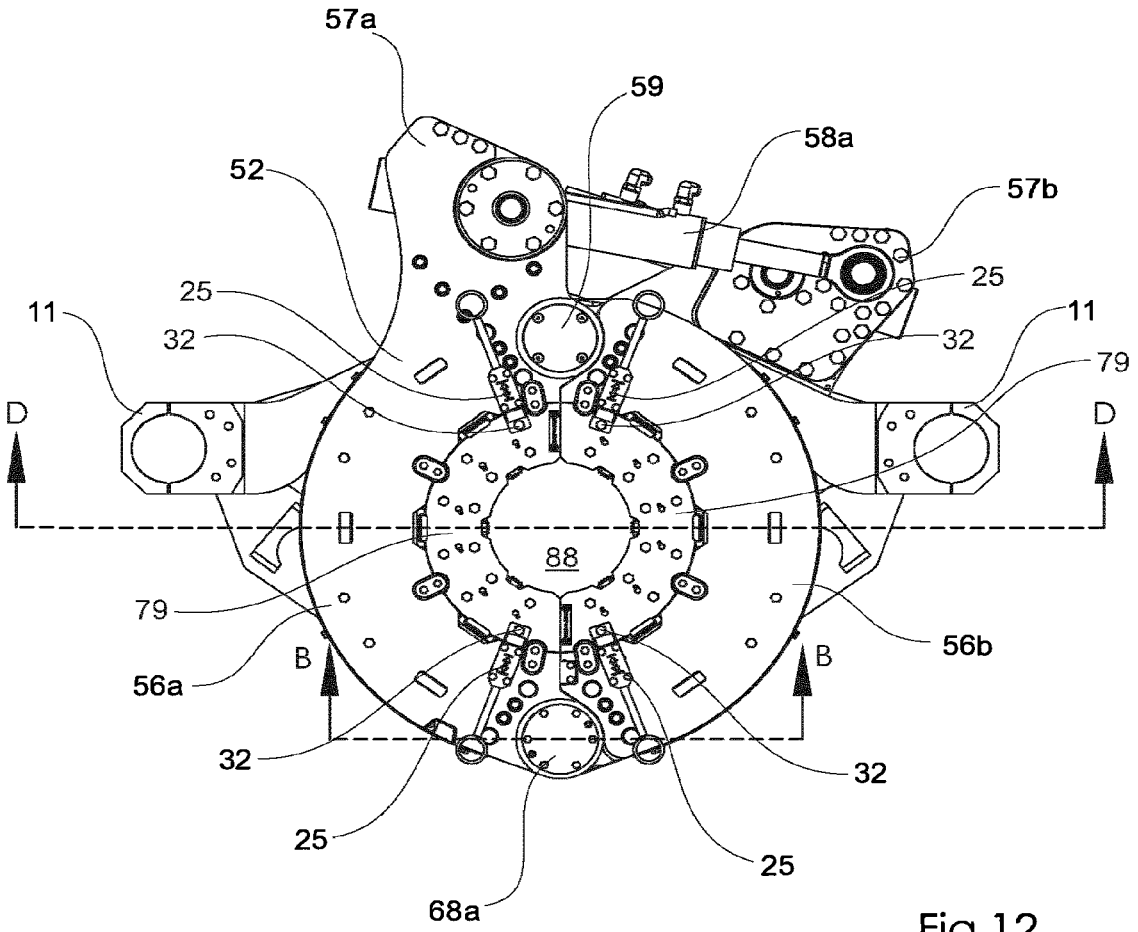
FIG. 12 is a top plan view of the tong assembly shown in FIG. 4.
Figure 16:
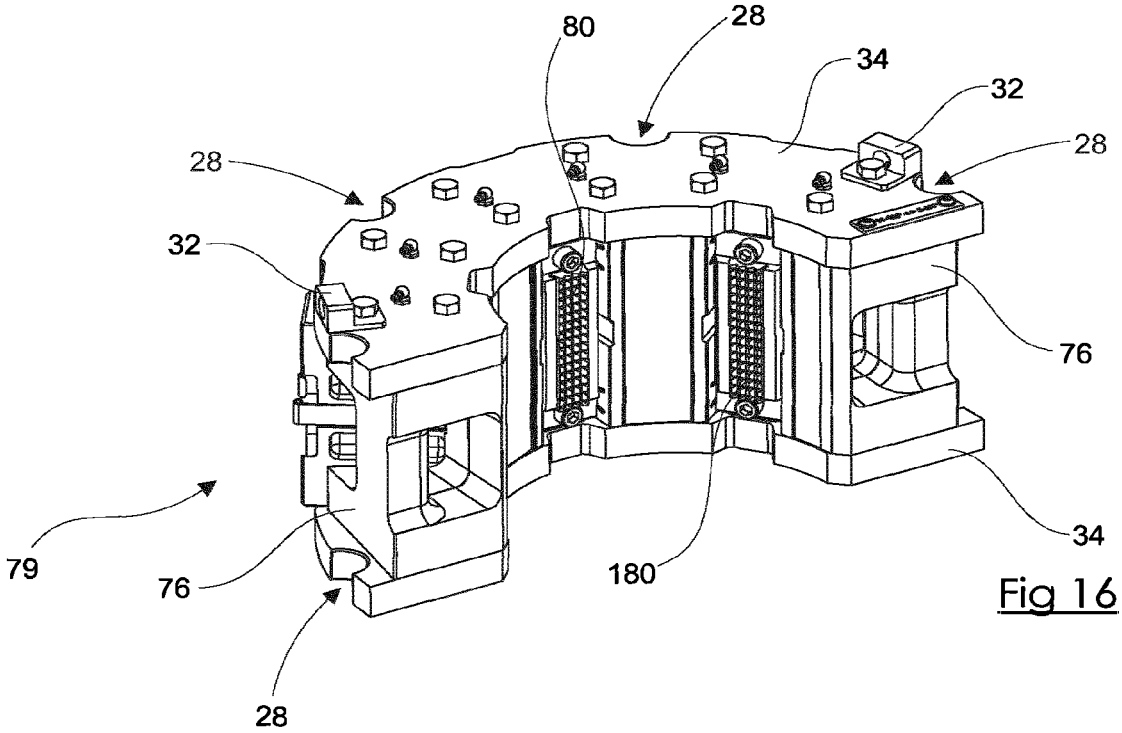
FIG. 16 is a front perspective view of a die cartridge of the tong assembly of the wrench of FIG. 1 according to one embodiment.
Figure 17:
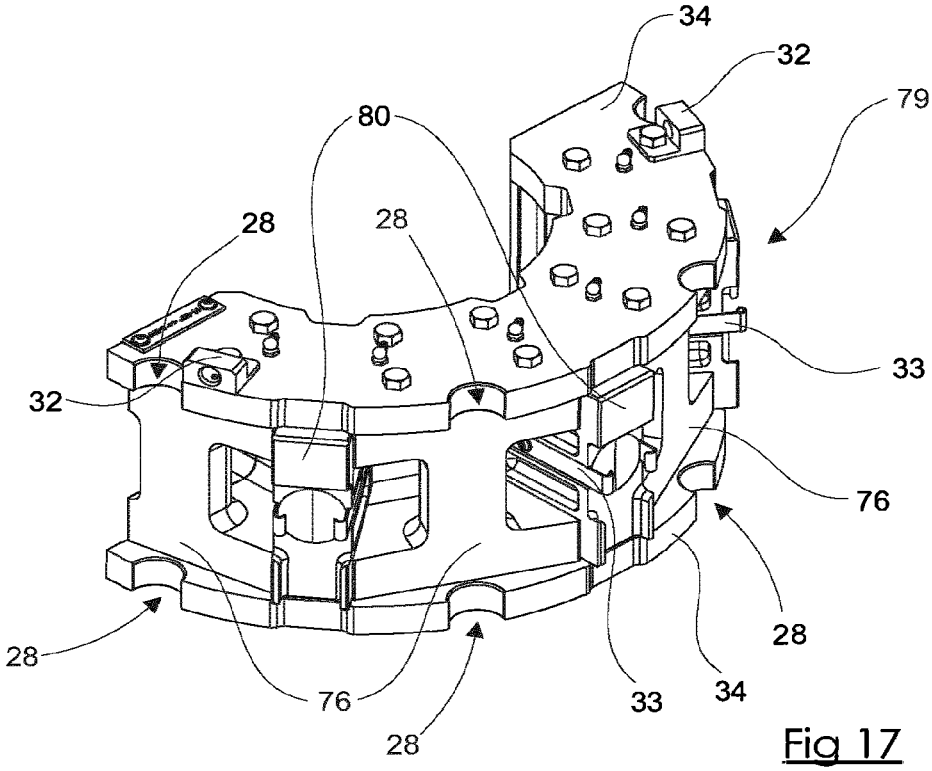
FIG. 17 is a rear perspective view of the die cartridge shown in FIG. 16.

With reference to FIGS. 12, 16, and 18, each die cartridge 79 may be inserted in an axial direction into a tong half by aligning the torque reaction pockets 28 with the torque reaction bars 17 such that each bar 17 is received in a pair of pockets 28, thereby restricting any relative rotational movement between the die cartridge and the tong half. Once inserted, the die cartridge 79 can be further removably secured to the tong half by at least one latch-type mechanism comprising, for example, a fastener 25 and a corresponding anchor 32. In the illustrated embodiment, when the at least one fastener 25 of the tong half is received in its corresponding anchor 32 of the die cartridge, and when the torque reaction bars 17 are matingly received in the corresponding torque reaction pockets 28, the die cartridge 79 is secured to the tong half When the fastener 25 is removed from the anchor 32, the die cartridge 79 is removable axially from the tong half by slidingly removing torque reaction bars 17 from the corresponding torque reaction pockets 28. As a person in the art can appreciate, other ways of securing die cartridge 79 to a tong half are possible.

When a die cartridge 79 is received in each of the tong halves 56*a*, 56*b*, 66*a*, 66*b*, and when the tong assembly 50 is in the closed position and the rotated closed position, the die cartridges in the upper and lower tongs 52, 54 define an open cylindrical space or "pipe opening" 88 therebetween. The diameter of the pipe opening 88 depends on the inner radius of the die cartridges 79. Preferably, all four die cartridges 79 used in the tong assembly 50 at any one time are similarly sized such that they all have about the same inner radius to provide concentric closure into opening 88. Accordingly, the diameter of pipe opening 88 can be increased or decreased by selecting die cartridges 79 with a larger or smaller inner radius, respectively.

As best shown in FIGS. 14 and 22, the spacing of the die rams 74 and the dies 80 is configured such that when the die cartridge 79 is received in a tong half, each die 80 is aligned with the ram rod 86 of one of die rams 74. In some embodiments, to extend die 80 inwardly towards the pipe opening 88, pressurized hydraulic fluid is supplied to the die ram housing 82, as known to those skilled in the art, to move piston 96 such that it pushes ram rod 86 through aperture 85, thereby pushing die 80 through between die guides 76. To retract die 80 away from the pipe opening 88, hydraulic fluid is supplied to the die ram housing 82, as known to those skilled in the art, to urge piston 96 back and withdraw ram rod 86 through aperture 85, thereby retracting die 80 back into the space between die holders 76. The die ram 74 is configured to extend die 80 into opening 88 by a range of distances (also referred to as "grip range"), for example from 0% to about 40% of the depth of the die holder 78. Preferably, when die 80 is extended into the opening 88, at least a portion of the die holder 78 remains between the adjacent die guides 76.

Since the diameter of pipe opening 88 depends on the inner radius of the die cartridge 79 and/or since the dies 80 in the die cartridge have a grip range, one size and configuration of die cartridges 79 can be used to handle and manipulate a range of pipes of different sizes, without modifying any component of the wrench 100. In some embodiments, the diameter of pipe opening 88 can range from about 3" to about 11¾" to accommodate pipe sizes of about 2⅜" to about 11". Further, since die cartridges 79 are removable, one set of die cartridges can be replaced with another set having a different inner radius and/or grip range to accommodate smaller or larger diameter pipes. In some embodiments, the inner radius and/or the grip range of the die cartridges 79 are selected depending on the size of the rig in order to eliminate or minimize the need to switch out the die cartridges.

Figure 23:
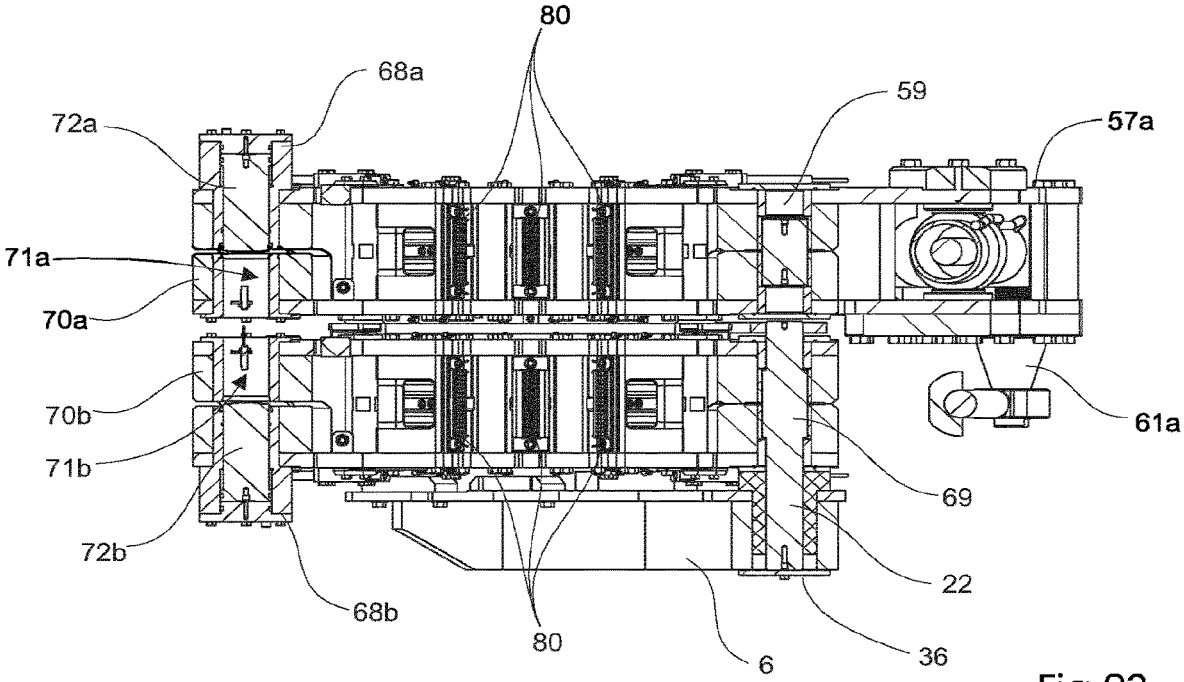
FIG. 23 is a side cross-sectional view of the tong assembly shown in FIG. 4.

In some embodiments, hydraulic fluid is supplied to all the die ram housings 82 in each tong 52,54 simultaneously such that the corresponding dies 80 can all extend synchronously. In further embodiments, hydraulic fluid is supplied to all the die ram housings 82 through a volumetric flow divider to each tong 52, 54 simultaneously to help equalize the volume of oil delivered to each die ram 74. Referring to FIGS. 15 and 23, one embodiment of locking pin assemblies 68*a*, 68*b* is shown. In some embodiments, each of the locking pin assemblies 68*a*,68*b* of tongs 52,54 comprises a lock pin 72*a*,72*b*. Lock pin 72*a*,72*b* may be a hydraulically operated pin for engaging an opening 71*a*,71*b* of the pin pockets 70*a*,70*b* of the tongs 52,54, respectively. Lock pin 72*a* operates to extend into the opening 71*a* of pin pocket 70*a* of the second upper tong half 56*b* to effectively lock the first and second upper tong halves 56*a*,56*b* together. Similarly, lock pin 72*b* operates to extend into the opening 71*b* of pin pocket 70*b* of the first lower tong half 66*a* to effectively lock the first and second lower tong halves 66*a*,66*b* together. To unlock the first and second tong halves, lock pins 72*a*,72*b* are retracted from openings 71*a*,71*b*, respectively, so that the first and second tong halves can be separated from one another. In some embodiments, a sensor can be provided at the end of lock pins 72*a*,72*b* to measure the closure of lock pins 72*a*,72*b* into pin pockets 70*a*, 70*b*.

To open mouth 90 of the tong assembly 50 to receive a drill pipe in pipe opening 88, as shown for example in FIGS. 4 and 5, the lock pins 72*a*,72*b* are removed from openings 71*a*,71*b* and the upper and lower rams 58*a*,58*b* are fully retracted to move the second ends of the upper tong halves 56*a*, 56*b* and the second ends of the lower tong halves 66*a*,66*b* away from one another so that tong assembly 50 can be moved towards the drill pipe and receive same within pipe opening 88. Once the drill pipe is received in pipe opening 88, the upper and lower rams 58*a*,58*b* are moved to the partially-retracted position to close mouth 90, as shown for example in FIGS. 6 and 7, to thereby place the tong assembly in the closed position. Once mouth 90 is closed, lock pins 72*a*,72*b* are operated as described above to lock the first and second upper tong halves 56*a*,56*b* and the first and second lower tong halves 66*a*,66*b* together, respectively, to allow the die cartridges 79 in the upper and lower tongs 52,54 to circumferentially surround the section of the drill pipe 48 in pipe opening 88, as shown for example in FIG. 22.

Figure 21:
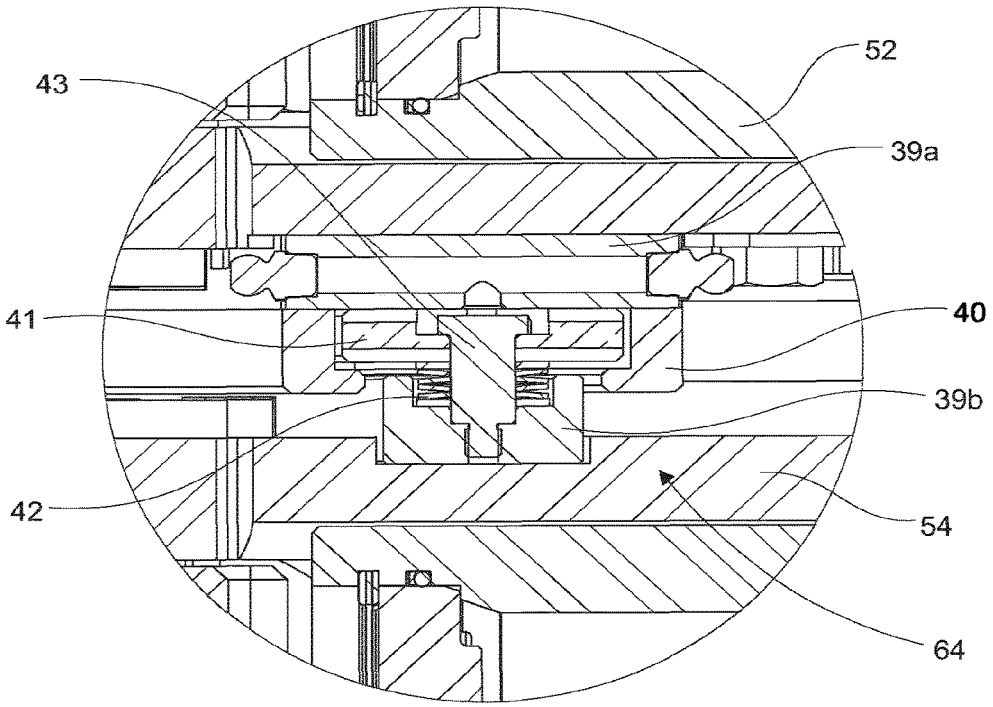
FIG. 21 is a detailed view of area "E" of the tong assembly shown in FIG. 20.

With reference to FIG. 21, the upper tong 52 is coupled to lower tong 54 by the central bearing 64. In some embodiments, the central bearing 64 comprises an upper section 39*a*, a lower section 39*b*, a side section 40, a wear section 41, preload spring washers 42, and preload bolt 43. Lower section 39*b* is secured to the lower tong 54 via upper tong plate 37. Upper section 39*a* and side section 40 are secured to the upper tong 52 via lower tong plate 38. The central bearing 64 is configured to have precise motion as the spring washers 42 create a preload to provide sufficient clearance to absorb any anomalies in the upper and lower tong halves 56*a*,56*b*,66*a*,66*b* during the operation of the wrench. The combination of the upper section 39*a*, lower section 39*b*, and side section 40 allows for small radial movements and also allows the central bearing 64 to self-align.

Referring to FIGS. 4 to 7, 10, and 11, the operation of tong assembly 50 is shown. In FIGS. 4 and 5, mouth 90 of the tong assembly 50 is opened by fully retracting the upper and lower rams 58*a*,58*b* to allow a drill string (not shown) to be placed in pipe opening 88. In some embodiments, the open-mouth tong assembly 50 can be positioned by positioning system 2 around the drill string. In FIGS. 6 and 7, mouth 90 is closed by simultaneously extending the upper and lower rams 58*a*,58*b* to the partially-retracted position, thereby overlapping the locking pin assemblies 68*a*,68*b* of the upper and lower tongs 52,54 with the pin pockets 70*a*,70*b*, respectively. The upper and lower tongs 52,54 are then locked by activating lock pins 72*a*,72*b*. In practice, the placement of tong assembly 50 relative to the drill string would be such that lower tong 54 would be positioned around a box end of a lower drill pipe section and upper tong 62 would be positioned around a pin end of an upper drill pipe section so as to make (or connect) or break (or disconnect) a joint between the drill pipe sections that makeup the drill string.

To make a joint, the dies 80 in the lower tong 54 are extended substantially synchronously by their corresponding die rams 74 to contact the drill pipe using a predetermined minimum hydraulic pressure, after the upper and lower tongs are locked. The upper and lower rams 58*a*,58*b* are then extended to the extended position, thereby rotating the upper tong 52 counterclockwise relative to the lower tong 54 and placing the tong assembly in the rotated closed position as best shown in FIGS. 10 and 11. Once the rams 58*a*,58*b* are extended, the dies 80 in the upper tong 52 are extended substantially synchronously by their corresponding die rams 74 to contact the drill pipe using a predetermined minimum hydraulic pressure. The rams 58*a*,58*b* are then retracted to the partially-retracted position or fully retracted position, which may depend on the torque measured by the load cell in rod pins 61*a*,61*b*, thereby rotating the upper tong 52 clockwise relative to the lower tong 54, which also rotates the drill pipe section engaged by the upper tong 52 in a clockwise direction, when viewed from above, relative to the other drill pipe section gripped by the lower tong 54. The dies 80 in the upper and lower tongs 52, 54 are then retracted to disengage from the pipe 48.

To break a joint, the dies 80 in the lower tong 54 are extended substantially synchronously by their corresponding die rams 74 to contact the drill pipe using a predetermined minimum hydraulic pressure, after the upper and lower tongs are locked. The dies 80 in the upper tong 52 are extended substantially synchronously by their corresponding die rams 74 to contact the drill pipe, either simultaneously with or immediately after the extension of dies 80 in the lower tong 54 using a predetermined minimum hydraulic pressure. Once the drill pipe is gripped by both the upper and lower tongs 52,54, the upper and lower rams 58*a*,58*b* are extended to the extended position, as best shown in FIGS. 10 and 11, thereby rotating the upper tong 52 counterclockwise relative to the lower tong 54, which also rotates the drill pipe section engaged by the upper tong 52 in a counterclockwise direction relative to the other drill pipe section gripped by the lower tong 54. The dies 80 in the upper tong 52 are then retracted to disengage from the drill pipe 48 and the rams 58*a*,58*b* are retracted to the partially-retracted position, as shown in FIGS. 6 and 7. The dies 80 in the lower tong 54 are then retracted to disengage from pipe 48.

The synchronization of the extension of the dies 80 in tong assembly 50 helps to keep the section of the drill pipe in upper tong 52 aligned and concentric with the other section of the drill pipe in the lower tong 54.

After making or breaking the joint, the upper and lower tongs 52,54 are unlocked by deactivating lock pins 72*a*,7*b*. Once unlocked, the tong assembly 50 can be opened by fully retracting the rams 58*a*,58*b*, as shown in FIGS. 4 and 5, thereby opening the mouth 90 through which the drill pipe can be removed from pipe opening 88 of tong assembly 50.

The incorporation of six die rams 74 in each tong, as shown in the illustrated embodiment, can enable the equal distribution of gripping force around the circumference of drill string 48 and prevent the crushing or squashing of drill string 48 such it becomes out of round when gripped by die rams 74. In addition, by distributing the gripping forces in multiple locations around the circumference of the drill string, less force per die ram 74 can be used to prevent deep scoring on the drill string caused by dies 80, which can occur if fewer die rams are used to grip the drill string, such as are found on similar apparatuses using only two or three die rams.

The mounting pivot 22 of carrier 6 is configured to allow the lower tong 54 to rotate in the event of slippage in the interface between the dies 80 and the pipe or when the lower tong 54 is improperly used as a backup for the spinner assembly (i.e., where the tong assembly 50 is used as a backup wrench such that all the torque is transferred to the positioning system 2 and into the rig floor).

In some embodiments, wrench 100 may comprise at least one carrier torque sensor mounted thereon for measuring rotational stresses. The carrier torque sensor can be mounted between positioning system 2 and tong assembly 50. In a sample embodiment shown in FIG. 23, the carrier torque sensor 36 can be mounted between tong assembly 50 and carrier 6 at mounting pivot 22.

In some embodiments, wrench 100 comprises a control system for controlling the operation of hydraulic rams and motors of the wrench 100. The control system can comprise one or more components selected from the group consisting of hydraulic fluid cylinders, hydraulic fluid pumps, hydraulic fluid tanks, hydraulic fluid coolers, hydraulic fluid filters, hydraulic fluid hoses, hydraulic fluid control valves and programmable logic controllers as well known to those skilled in the art.

In operation, by placing the carrier torque sensor between one of the pins extending downwardly from tong assembly 50 and carrier 6 at pivot 22, rotational force between tong assembly 50 and carrier 6 can be monitored. It is known that when automated floor wrenches are used on drilling rigs using top drives for rotating the drill string, drilling operators have been known to use the top drive to make joints between sections of drill pipe instead of using the automated floor wrench. Top drives can produce large amounts of torque, far more than what is necessary to properly torque sections of drill pipe together. Using the top drive to make the joints can apply excessive rotational force to the automated floor wrench, which is still being used to grip to lower section of drill pipe, and cause damage to the floor wrench. By incorporating the carrier torque sensor in the mounting of tong assembly 50 to carrier 6 at pivot 22, the carrier torque sensor can be used to sense when excessive rotational force is applied to the wrench 100. When excessive rotational force is applied to lower tong 54, carrier torque sensor can send a signal to the control system that can, in turn, cause tong assembly 50 to release any pipe gripped by it. In the instance when wrench 100 is used with a top drive drilling rig, and its operators simply use wrench 100 to grip the drill string with lower tong 54 and use the top drive to make joints with the drill string, the carrier torque sensor can be used to sense when the rotational force is applied to longer tong 54 by the top drive exceeds a predetermined threshold, and send a signal to the control system to cause lower tong 54 to release the drill string, thereby preventing damage to wrench 100. In further embodiments, the control system can also shut down the operation of the top drive and any other system that was operating prior to the carrier torque sensor sending the signal to the control system.

In other operational situations, such as during break-out operations, it is known that a drill string can slip in a lower tong when the upper tong is trying to break a joint in adjacent sections of pipe in the drill string. When this occurs, excessive rotational forces can occur in lower tong 54, which can damage carrier 6 and positioning system 2. By connecting the carrier torque sensor between lower tong 54 and carrier 6 at pivot 22, such rotational forces can be detected by the carrier torque sensor. When the rotational forces exceed a predetermined threshold, the carrier torque sensor can send a signal to the control system to, in turn, cause tong assembly 50 to release the drill string. In further embodiments, the control system also shut down the operation of the top drive and any other system that was operating prior to the carrier torque sensor sending the signal to the control system. Using a single ram assembly to both (i) open and close the tong assembly and (ii) rotate the upper tong relative to the lower tong provides the tong assembly 50 of the present disclosure more capacity in terms of rotational engagement and torque than previous floor wrenches of the same footprint. Further, the synchronous movement of the upper and lower rams 58*a*,58*b* of the tong assembly 50 allows the wrench 100 to provide more torque as well as more rotational per grip than its predecessors. In one embodiment, the wrench 100 can provide a maximum break out torque of about 150,000 lbs, a maximum make up torque of about 130,000 lbs, a nominal pressure of about 2500 (dif.) psi, and a maximum pressure of about 3000 psi.

The tong assembly 50 of the present disclosure only has two tong halves in each tong as opposed to at least four tong sections in each tong of the predecessors. The simplicity of the configuration of tong assembly 50 may reduce manufacturing and/or maintenance costs.

Accordingly, a wrench for making up or breaking up a pipe joint is provided. The wrench comprises a tong assembly comprising: an upper tong comprising a first upper tong half pivotably connected to a second upper tong half at their first ends, the first and second upper tong halves being releasably connectable at their second ends; a lower tong comprising a first lower tong half pivotably connected to a second lower tong half at their first ends, the first and second lower tong halves being releasably connectable at their second ends; a central bearing operatively coupling the upper tong and the lower tong to allow the upper tong to rotate relative to the lower tong; and a ram assembly for pushing or pulling the upper tong at a tangential location thereof; and wherein the ram assembly is configured to move the tong assembly between an open position where the second ends of the first and second upper tong halves and the second ends of the first and second lower tong halves are separated to define a mouth therebetween, and a closed position where the second ends of the first and second upper tong halves and the second ends of the first and second lower tong halves are engaged to defined an opening between the first upper and lower tong halves and the second upper and lower tong halves; wherein the ram assembly is fully retractable to place the tong assembly in the open position; and wherein the ram assembly is partially retractable to place the tong assembly in the closed position.

In one embodiment, the tong assembly further comprises a first rotated closed position where the second ends of the first and second upper tong halves are securely connected; the second ends of the first and second lower tong halves are securely connected; and the ram assembly is extended to rotate the upper tong counterclockwise relative to the lower tong.

In one embodiment, the tong assembly further comprises a second rotated closed position where the second ends of the first and second upper tong halves are securely connected; the second ends of the first and second lower tong halves are securely connected; and the ram assembly is partially retractable or fully retractable to rotate the upper tong clockwise relative to the lower tong.

In one embodiment, the wrench further comprises a die cartridge removably receivable in each of the first and second upper tong halves and the first and second lower tong halves, the die cartridge comprising one or more dies, and the one or more dies are extendable radially inwardly substantially toward a center of the opening and retractable therefrom; and wherein when the tong assembly is in the closed position, a pipe opening is defined between the die cartridges.

In one embodiment, each of the first and second upper tong halves and the first and second lower tong halves comprises one or more die rams configured to extend and retract the one or more dies.

In one embodiment, the one or more die rams in the first upper tong half and the one or more die rams in the second upper tong half are configured to synchronously extend the one or more dies in the first upper tong half and the one or more dies in the second upper tong half and the one or more die rams in the first lower tong half and the one or more die rams in the second lower tong half are configured to synchronously extend the one or more dies in the first lower tong half and the one or more dies in the second lower tong half.

In one embodiment, the ram assembly comprises an upper ram and a lower ram, the upper ram being pivotably coupled at a first end to the upper tong and at a second end to the lower tong, and the lower ram being pivotably coupled at a first end to the lower tong and at a second end to the upper tong.

In one embodiment, the upper and lower rams are extendable or retractable substantially synchronously.

In one embodiment, the first end of the upper ram is pivotably coupled to the upper tong at or near the first end of the first upper tong half and the second end of the upper ram is pivotably coupled to the lower tong at or near the first end of the second lower tong half.

In one embodiment, the first end of the lower ram is pivotably coupled to the lower tong at or near the first end of the second lower tong half; and the second end of the lower ram is pivotably coupled to the upper tong at or near the first end of the first upper tong half.

In one embodiment, the upper ram is coupled to the lower tong by a first rod pin and the lower ram is coupled to the upper tong by a second rod pin.

In one embodiment, the wrench further comprises a torque sensor disposed at the first rod pin and/or the second rod pin.

In one embodiment, the second ends of the first and second uppers tong halves and/or the second ends of the first and second upper tong halves are securably connectable by a lock pin.

In one embodiment, the wrench further comprises a rotatable positioning system, and wherein the tong assembly is secured to and supported on the positioning system, the positioning system being mountable to a drilling rig floor.

In one embodiment, the wrench further comprises a torque sensor disposed between the tong assembly and the positioning system.

In one embodiment, the wrench further comprises a control system for controlling the operation of the tong assembly.

In one embodiment, the wrench further comprises a carrier, and wherein the lower tong is secured to and supported on the carrier.

A method of operating a tong assembly of a wrench is also provided. The method comprises: opening a tong assembly to provide access to a pipe opening defined therein by retracting a ram assembly coupled to the tong assembly, the tong assembly comprising an upper tong and a lower tong and a central bearing operatively coupling the upper and lower tongs to allow relative rotational movement therebetween, and the ram assembly being coupled to the upper tong and the lower tong; closing the tong assembly by extending the ram assembly, thereby pushing the upper tong at a tangential location thereof; and locking the upper and lower tongs.

In one embodiment, the method further comprises inserting and securing a die cartridge in each half of the upper and lower tongs, wherein the die cartridge comprises one or more dies and each half having one or more die rams for operatively engaging the one or more dies.

In one embodiment, the ram assembly comprises an upper ram and a lower ram, the upper ram being pivotably coupled at a first end to the upper tong and at a second end to the lower tong, and the lower ram being pivotably coupled at a first end to the lower tong and at a second end to the upper tong.

In one embodiment, the upper and lower rams are extendable or retractable substantially synchronously.

In one embodiment, the method further comprises, after opening the tong assembly and before closing the tong assembly, receiving a pipe joint in the pipe opening.

In one embodiment, the method further comprises, after locking the upper and lower tongs, securely engaging the pipe joint by extending the one or more dies in the lower tong radially inwardly using the one or more die rams in the lower tong.

In one embodiment, the method further comprises: rotating the upper tong counterclockwise relative to the lower tong by extending the ram assembly; securely engaging the pipe joint by extending the one or more dies in the upper tong radially inwardly using the one or more die rams in the upper tong; rotating the upper tong clockwise relative to the lower tong by retracting the ram assembly; retracting the one or more dies in the upper and lower tongs; unlocking the upper and lower tongs; and reopening the tong assembly to remove the pipe joint from the tong assembly.

In one embodiment, the method further comprises: securely engaging the pipe joint by extending the one or more dies in the upper tong radially inwardly using the one or more die rams in the upper tong; rotating the upper tong counterclockwise relative to the lower tong by extending the ram assembly; retracting the one or more dies in the upper tong; rotating the upper tong clockwise relative to the lower tong by retracting the ram assembly; retracting the one or more dies in the lower tong; unlocking the upper and lower tongs; and reopening the tong assembly to remove the pipe joint from the tong assembly.

Figure 24A:
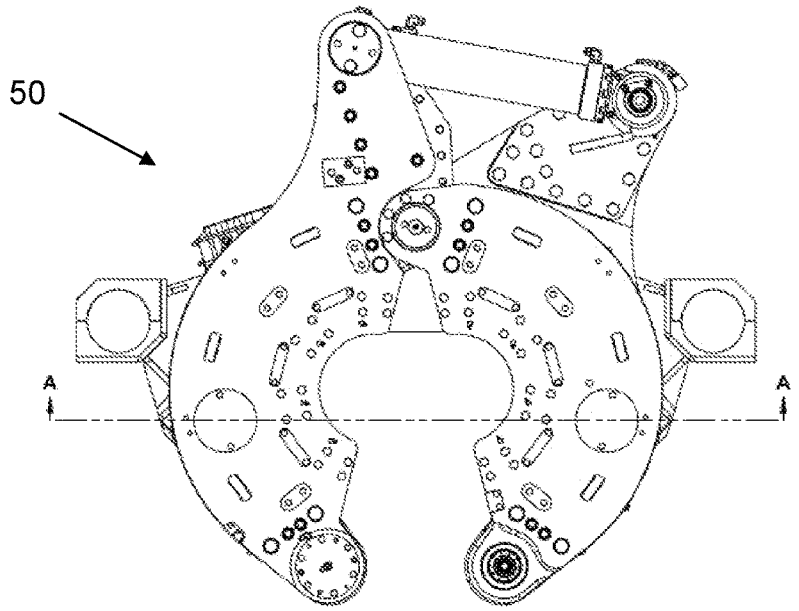
FIG. 24A is a top plan view of the tong assembly of the wrench shown in FIG. 1 according to one embodiment, the tong assembly being shown in an open position.
Figure 24B:
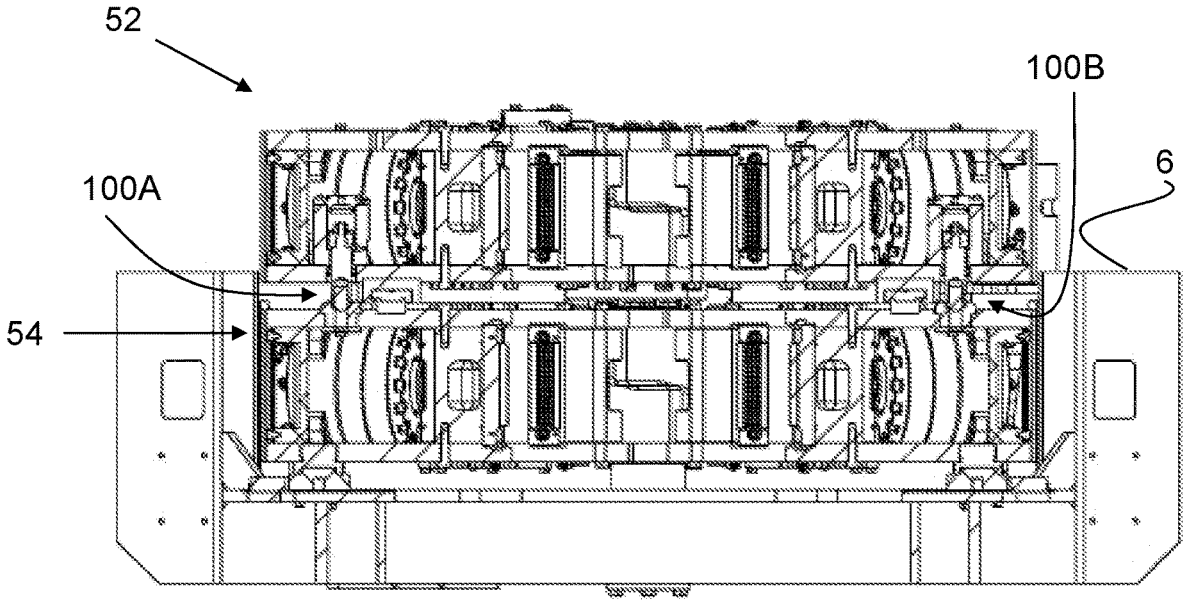
FIG. 24B is a cross-sectional view of the tong assembly, taken along line A-A of FIG. 24A.
Figure 25A:
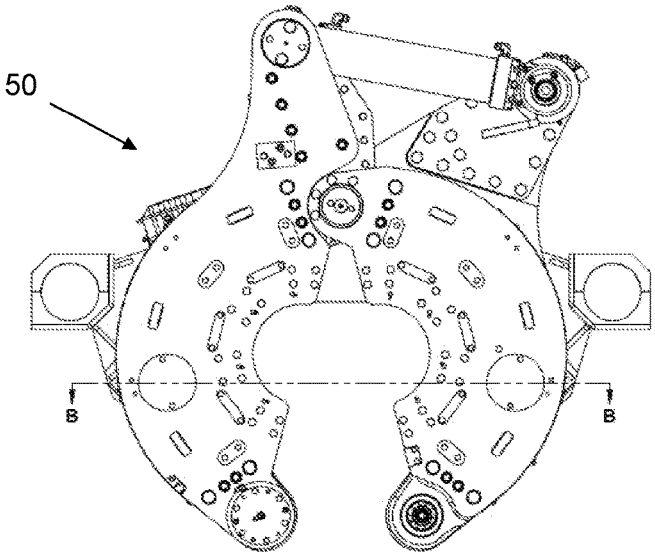
FIG. 25A is a top plan view of the tong assembly of the wrench shown in FIG. 1 according to one embodiment, the tong assembly being shown in an open position.
Figure 25B:
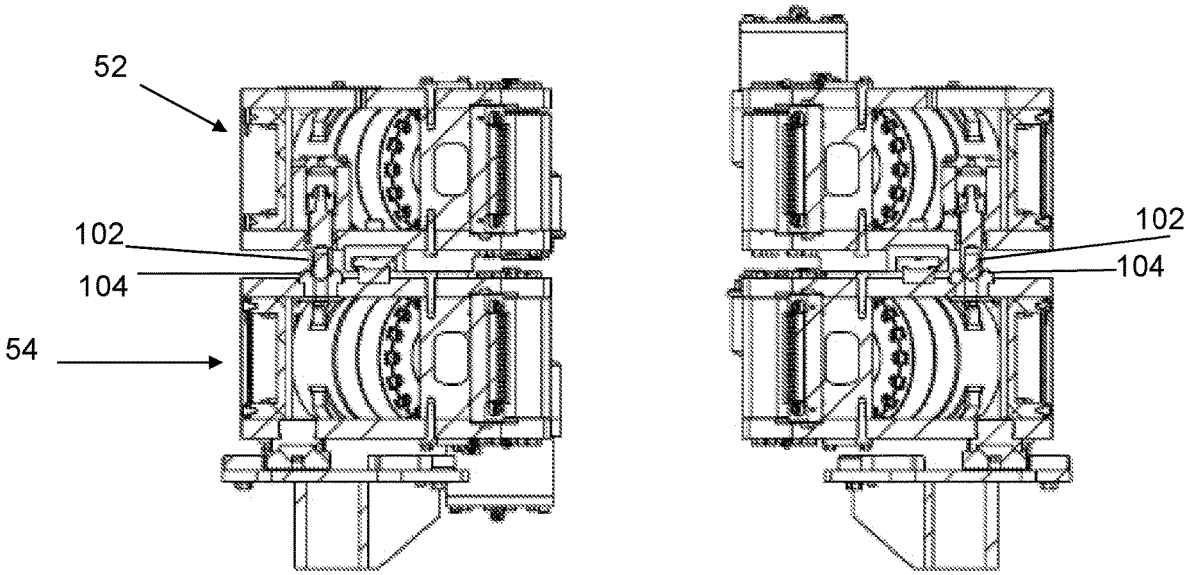
FIG. 25B is a cross-sectional view of the tong assembly, taken along line B-B of FIG. 25A.
Figure 26A:
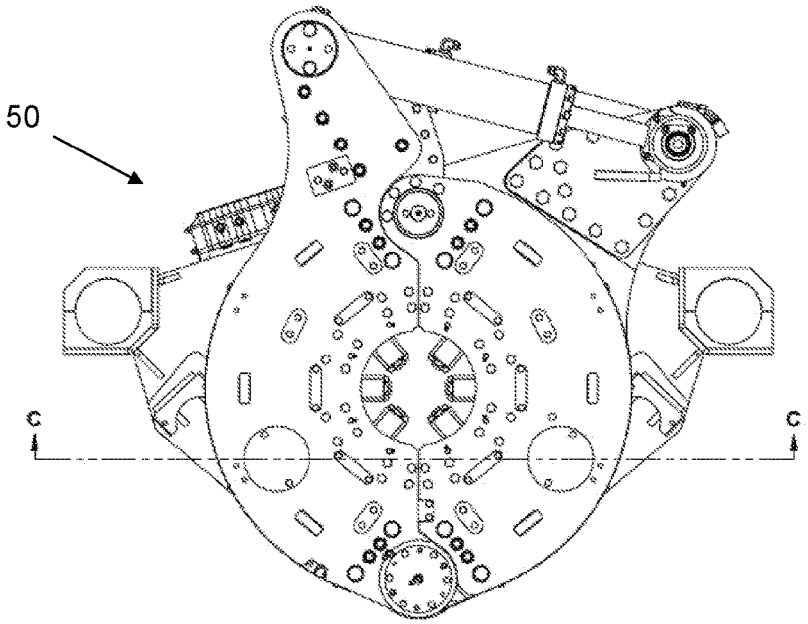
FIG. 26A is a top plan view of the tong assembly of the wrench shown in FIG. 1 according to one embodiment, the tong assembly being shown in a closed position.
Figure 26B:
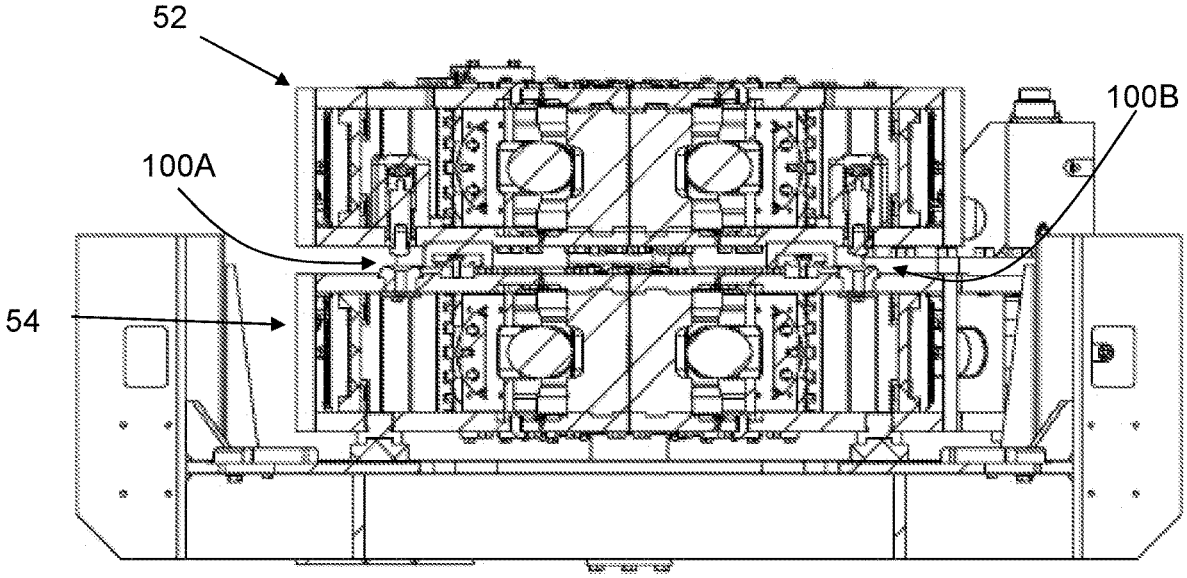
FIG. 26B is a cross-sectional view of the tong assembly, taken along line C-C of FIG. 26A.
Figure 27A:
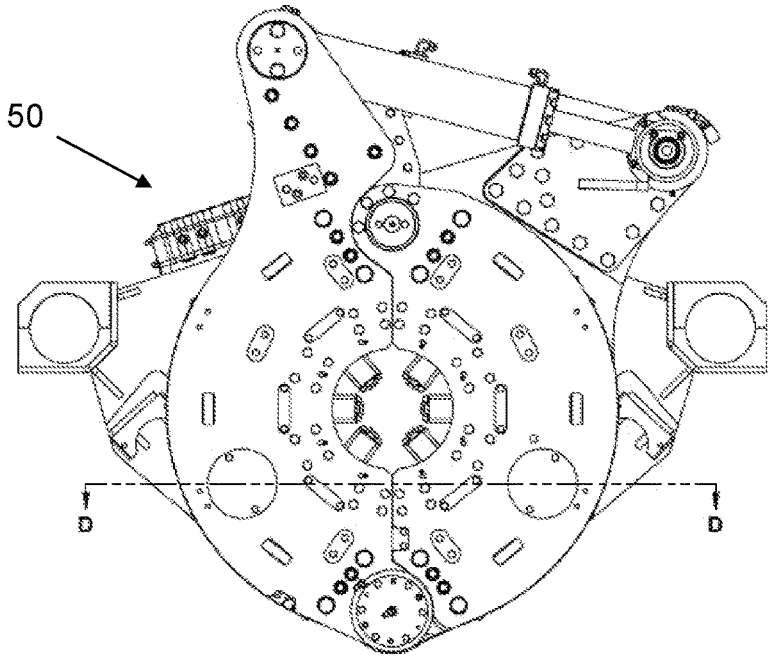
FIG. 27A is a top plan view of the tong assembly of the wrench shown in FIG. 1 according to one embodiment, the tong assembly being shown in a closed position.
Figure 27B:
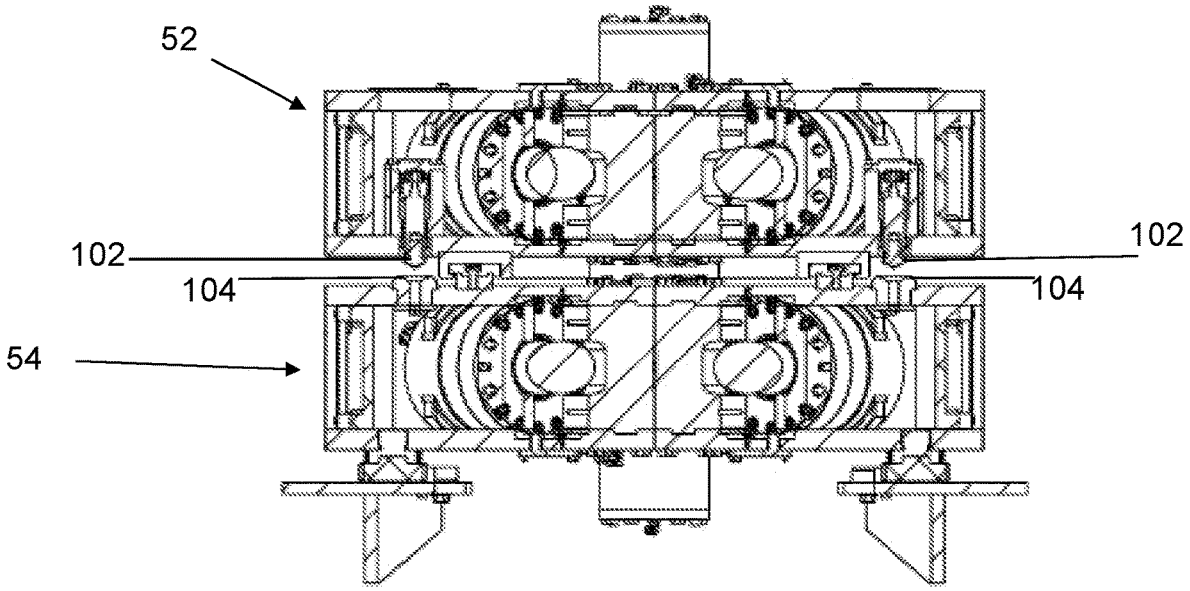
FIG. 27B is a cross-sectional view of the tong assembly, taken along line D-D of FIG. 27A.

Some embodiments of the present disclosure relate to one or more coupling assemblies that are configured to releasably and operatively couple the upper tong 52 and the lower tong 54. FIG. 24A, FIG. 24B, FIG. 25A and FIG. 25B all show the tong assembly 50 in the open position. FIG. 26A, FIG. 26B, FIG. 27A and FIG. 27B all show the tong assembly in the closed position. FIG. 24B shows a cross-section through line A-A of FIG. 24A, wherein two coupling assemblies 100A and 100B are shown. As shown at least in the non-limiting example of FIG. 25B, each coupling assembly 100A, 100B comprises a pin 102 and a seat 104. The pin 102 may be moveably secured by a portion of the upper tong 52 with the seat 104 fixed by a portion of the lower ton 54, or vice versa. The pin 102 is configured to move between an extended position (as shown in FIG. 24B and FIG. 25B) and a retracted position (as shown in FIG. 26B and FIG. 27B). The pin 102 can move between the extended and retracted positions by a hydraulic, pneumatic or electronically powered system so that a user can control the position of the pin 102.

When the pin 102 is in the extended position it couples with the seat 104 so that the coupling assembly 100 is coupled and the upper tong 52 and the lower tong 54 are operatively coupled and can move between the open position and the closed position in unison. When the pin 102 is in the retracted position, the coupling assembly 100 is not coupled (uncoupled) from the seat 104 so that the upper tong 52 can move independently from the lower tong 54 and, as the case may be, the lower tong 54 may move independently from the upper tong 52. For example, when the pin 102 is retracted and the tong assembly 50 is in the closed position, the upper tong 52 can be rotated clockwise or counterclockwise relative to the lower tong 54, as described herein above in respect of making or breaking the joint.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof.

What is claimed is:

1. A wrench for making up or breaking up a pipe joint, the wrench comprising:

a tong assembly comprising:

an upper tong comprising a first upper tong half pivotably connected to a second upper tong half at their first ends, the first and second upper tong halves being releasably connectable at their second ends;

a lower tong comprising a first lower tong half pivotably connected to a second lower tong half at their first ends, the first and second lower tong halves being releasably connectable at their second ends;

a coupling assembly for releasably and operatively coupling the upper tong and the lower tong; and a central bearing operatively coupling the upper tong and the lower tong to allow the upper tong to rotate relative to the lower tong; and a ram assembly for pushing or pulling the upper tong at a tangential location thereof;

wherein the ram assembly is configured to move the tong assembly between an open position where the second ends of the first and second upper tong halves and the second ends of the first and second lower tong halves are separated to define a mouth therebetween, and a closed position where the second ends of the first and second upper tong halves and the second ends of the first and second lower tong halves are engaged to define an opening between the first upper and lower tong halves and the second upper and lower tong halves;

wherein when the coupling assembly is coupled the ram assembly is moveable in a first direction to place the tong assembly in the open position;

wherein when the coupling assembly is coupled the ram assembly is moveable in a second direction to place the tong assembly in the closed position;

wherein when the tong assembly is placed in the closed position and the coupling assembly is uncoupled, the ram assembly is further moveable in the second direction to rotate the upper tong in a first rotational direction relative to the lower tong; and wherein the ram assembly is moveable in the first direction to rotate the upper tong in a second rotational direction relative to the lower tong, wherein the first rotational direction is opposite to the second rotational direction.

2. The wrench of claim 1, wherein the first rotational direction is counterclockwise when viewed from above.

3. The wrench of claim 1, wherein the first rotational direction is clockwise when viewed from above.

4. The wrench of claim 1, wherein the coupling assembly comprises a pin and a seat, wherein the pin is moveable between an extended position and a retracted position, wherein when the pin is in the extended position the coupling assembly is coupled and when the pin is in the retracted position the coupling assembly is uncoupled.

5. The wrench of claim 4, wherein the pin is moveably secured by a portion of the upper tong and the seat is secured by a portion of the lower tong.

6. The wrench of claim 4, wherein the pin is moveably secured by a portion of the lower tong and the seat is secured by a portion of the upper tong.

7. The wrench of claim 1, further comprising a die cartridge removably receivable in each of the first and second upper tong halves and the first and second lower tong halves, the die cartridge comprising one or more dies, and the one or more dies are extendable radially inwardly substantially toward a center of the opening and retractable therefrom; and wherein when the tong assembly is in the closed position, a pipe opening is defined between the die cartridges.

8. The wrench of claim 7, wherein each of the first and second upper tong halves and the first and second lower tong halves comprises one or more die rams configured to extend and retract the one or more dies.

9. The wrench of claim 1, wherein the ram assembly comprises an upper ram and a lower ram.

10. The wrench of claim 9, wherein the upper ram is coupled to the lower tong by a first rod pin and the lower ram is coupled to the upper tong by a second rod pin, wherein the wrench further comprises a torque sensor disposed at the first rod pin and/or the second rod pin.

11. The wrench of claim 1, wherein the second ends of the first and second upper tong halves and/or the second ends of the first and second lower tong halves are securably connectable by a lock pin.

12. The wrench of claim 11, further comprising a torque sensor disposed between the tong assembly and a rotatable positioning system that is configured to secure and support the tong assembly upon a drilling rig floor.

13. The wrench of claim 1, further comprising one or more alignment features for operatively coupling the upper tong to the lower tong to prevent rotational movement of the upper tong to the lower tong during an initial movement of the ram assembly in the first direction.

14. A method of operating a wrench, the method comprising:

opening a tong assembly to provide access to a pipe opening defined therein by moving a ram assembly in a first direction, the tong assembly comprising an upper tong and a lower tong and a central bearing operatively coupling the upper and lower tongs and to allow relative rotational movement therebetween, and the ram assembly being coupled to the upper tong and the lower tong and a coupling assembly is coupled to releasably and operatively couple the upper tong and the lower tong;

after opening the tong assembly, receiving a pipe joint in the pipe opening;

after receiving the pipe joint, closing the tong assembly by moving the ram assembly in a second direction, thereby pushing the upper tong and the coupled lower tong at a tangential location thereof;

after closing the tong assembly, securely engaging the pipe joint by extending one or more dies in the lower tong radially inwardly within the pipe opening using one or more die rams in the lower tong;

uncoupling the coupling assembly;

further moving the ram assembly in the second direction to rotate the upper tong in a first rotational direction relative to the lower tong; and moving the ram assembly in the first direction to rotate the upper tong in a second rotational direction relative to the lower tong.

15. The method of claim 14, further comprising, after closing the tong assembly, securely engaging the pipe joint by extending one or more dies in the upper tong radially inwardly within the pipe opening using one or more die rams in the upper tong.

16. The method of claim 14, further comprising:

retracting the one or more dies in the upper and lower tongs;

opening the tong assembly by retracting the ram assembly; and removing the pipe joint from the tong assembly.

* * * * *